US006363863B1

(12) United States Patent
Dohr

(10) Patent No.: US 6,363,863 B1
(45) Date of Patent: Apr. 2, 2002

(54) GATE ASSEMBLY FOR A RAILROAD HOPPER CAR

(75) Inventor: Jeremy J. Dohr, Crown Point, IN (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 09/618,754

(22) Filed: Jul. 18, 2000

(51) Int. Cl.[7] ..... B61D 7/24

(52) U.S. Cl. ..... 105/247; 105/254; 105/282.2; 105/294; 105/305

(58) Field of Search ..... 105/254, 282.1, 105/282.2, 282.3, 294, 247, 305, 308.1, 313; 222/181.1, 181.2, 181.3, 561, 542, 545, 450, 451; 414/505, 520, 526

(56) References Cited

U.S. PATENT DOCUMENTS

| | | | | | |
|---|---|---|---|---|---|
| 3,316,030 | A | | 4/1967 | Kemp | |
| 3,332,363 | A | | 7/1967 | Becker | |
| 3,393,017 | A | * | 7/1968 | Smith | 105/310 |
| 3,415,204 | A | | 12/1968 | Pase | |
| 3,446,538 | A | | 5/1969 | Danielson | |
| 3,451,726 | A | | 6/1969 | Nagy | |
| 3,529,747 | A | | 9/1970 | Mundinger | |
| 3,536,013 | A | | 10/1970 | Nagy | |
| 3,578,815 | A | | 5/1971 | Mundinger et al. | |
| 3,580,642 | A | | 5/1971 | Nagy | |
| 3,650,567 | A | | 3/1972 | Danielson | |
| 3,708,209 | A | * | 1/1973 | Dugge | 302/52 |
| 3,779,172 | A | | 12/1973 | Schipper et al. | |
| 3,797,891 | A | * | 3/1974 | Fritz | 302/52 |
| 3,807,318 | A | * | 4/1974 | Chierici | 105/282 A |
| 3,831,803 | A | * | 8/1974 | Hutchinson et al. | 220/46 R |
| 3,843,204 | A | | 10/1974 | Fischer | |
| 3,845,726 | A | | 11/1974 | Fuller | |
| 3,877,392 | A | * | 4/1975 | Akester et al. | 105/282 P |
| 3,893,398 | A | * | 7/1975 | Fischer | 105/308 R |
| 3,956,996 | A | * | 5/1976 | Fischer | 105/308 B |
| 3,958,514 | A | * | 5/1976 | Akester et al. | 105/282 A |
| 4,151,935 | A | * | 5/1979 | Dugge | 222/556 |
| 4,256,042 | A | | 3/1981 | Fischer | |
| 4,360,295 | A | | 11/1982 | Anderson | |
| 4,568,224 | A | | 2/1986 | Dugge et al. | |
| 4,617,868 | A | | 10/1986 | Wahlstrom et al. | |
| 4,695,207 | A | | 9/1987 | Miller | |
| 4,765,517 | A | * | 8/1988 | Pavolka | 222/505 |
| 5,353,713 | A | | 10/1994 | Dohr et al. | 105/310 |

(List continued on next page.)

*Primary Examiner*—S. Joseph Morano
*Assistant Examiner*—Frantz F. Jules
(74) *Attorney, Agent, or Firm*—John W. Harbst

(57) ABSTRACT

A discharge gate assembly for a railroad hopper car is disclosed. The gate assembly includes a frame defining a discharge opening and a gate or first element slidably carried on the frame for controlling the discharge of material from the hopper car through the discharge opening. The gate assembly further includes a second slidable element carried by the frame in vertically spaced relation relative to the first element and extending across the discharge opening. A first drive mechanism including a first operating shaft assembly is mounted on the gate frame for slidably moving the first element relative to the frame. A second drive mechanism including a second operating shaft assembly is also mounted on the gate frame for slidably moving the second element relative to the gate frame. The operating shaft assemblies are mounted for rotation about independent fixed axes and in horizontally adjacent relation relative to each other. A single lock assembly is also provided for releasably but separately holding the first and second element in a closed position. The second slidable element is preferably configured as an open top pan assembly having outlet tubes extending laterally therefrom. A closure assembly including an end cap or cover is provided in combination with a free end of each outlet tube allowing for one-handed operation of the closure assembly.

91 Claims, 17 Drawing Sheets

U.S. PATENT DOCUMENTS 5,613,446 A 3/1997 DiLuigi et al. ..... 105/282.2
5,671,684 A 9/1997 Lucas ..... 105/305
5,829,359 A * 11/1998 Dohr et al. ..... 105/310
6,012,397 A 1/2000 Krahl ..... 105/286
6,073,562 A 6/2000 Cozine et al. ..... 105/247
6,123,030 A 9/2000 Dohr et al. ..... 105/282.2
6,129,499 A * 10/2000 Adams ..... 414/505

* cited by examiner

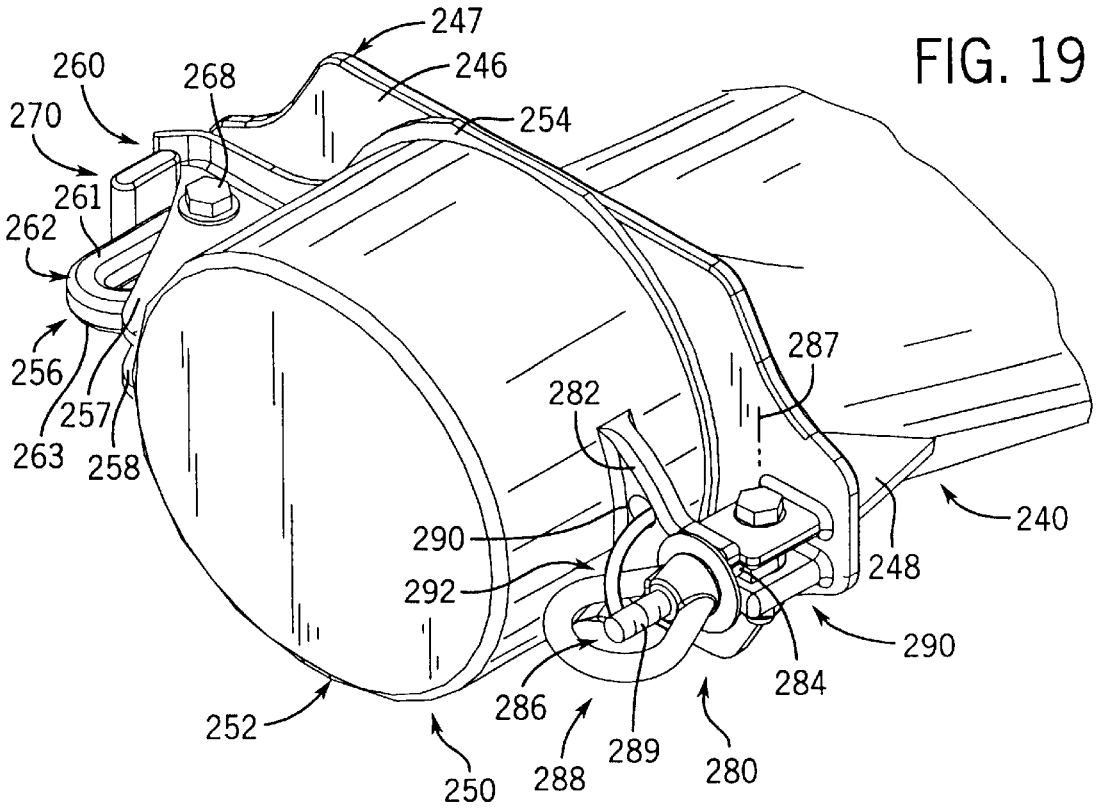
FIG. 19
FIG. 20
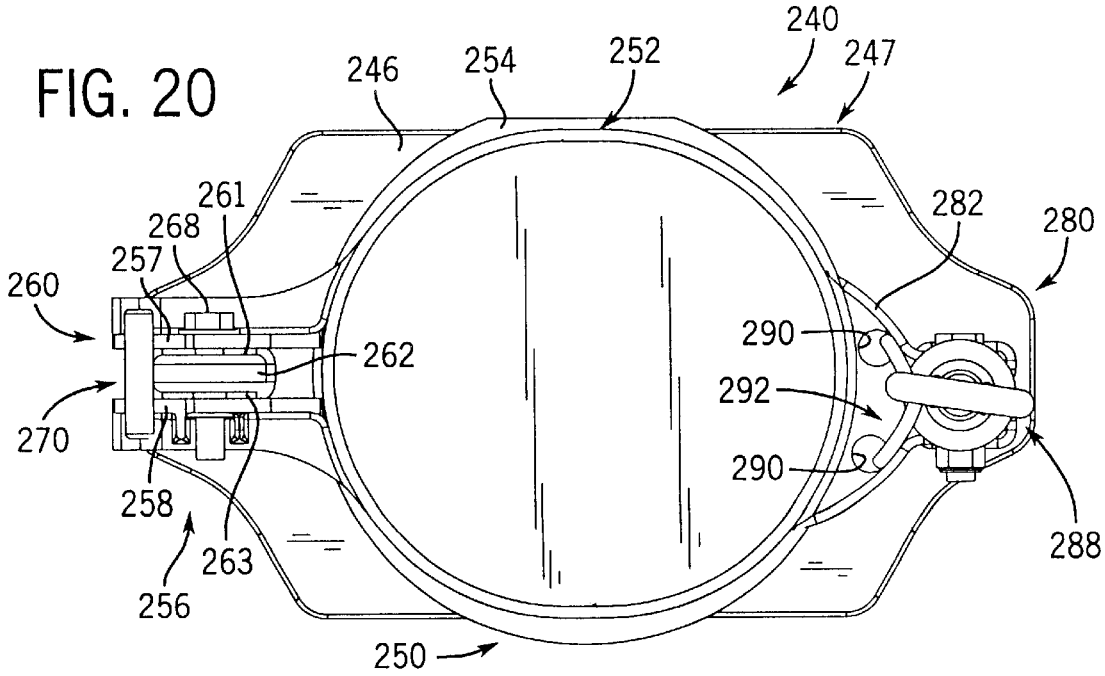

GATE ASSEMBLY FOR A RAILROAD HOPPER CAR

FIELD OF THE INVENTION

The present invention generally relates to railroad hopper cars which transport and releasably hold food grade materials therein and, more particularly, to a gate assembly for a railroad hopper car which allows such food grade materials to be discharged from the hopper car either pneumatically or gravitationally.

BACKGROUND OF THE INVENTION

Railroad hopper cars typically include an underframe for supporting a walled enclosure in which bulk materials are held and transported. As is conventional, the underframe of the railroad car is supported toward opposite ends by well known wheeled trucks which ride on tracks or rails. A bottom of the walled enclosure is usually provided with two or more individual openings for allowing bulk materials to be discharged from the walled enclosure. The walled enclosure of the railroad car furthermore typically includes sloped or slanted walls or sheets angularly extending upwardly from a periphery of each opening to promote gravitational movement of the bulk material toward the opening.

In the prior art, combination gravity and pneumatic gate structures have been provided which permit the discharge of material from the walled enclosure of a hopper car either by gravity or pressure differential such as vacuum. Such a gate structure typically includes a frame arranged in registry with an opening on the hopper car and a gate which is positioned beneath the opening on the hopper car for movement along a predetermined path of travel. The gate is typically mounted for sliding movement on the frame between open and closed positions. Most gate assemblies include a gate drive mechanism typically in the form of an operating shaft assembly extending laterally across one end of the gate assembly for operationally moving the gate between open and closed positions. In most gate designs, the operating shaft assembly combines with a rack and pinion assembly to move the gate depending upon the rotational direction of the operating shaft assembly. In some gate designs, such a rack and pinion assembly includes a pair of elongated stationary racks projecting in parallel relation relative to each other away from the frame and which intermesh with pinions mounted on the operating shaft assembly. The pinions on the operating shaft assembly are operably connected to and move with the gate. When in an open position, the gate allows the commodity to gravitational pass and be discharged from the hopper car.

At the railroad car unloading station, a powered driver is moved into driving engagement with one end of and turns the operating shaft assembly. As such, the pinions move along the stationary racks, thus, moving the gate therewith. As is conventional, the drivers which impart rotational movements to the operating shaft assembly are mounted on wheels and are readily movable in a direction extending generally parallel to a longitudinal axis of and are movable toward and away from the operating shaft assembly, as required. Such drivers, however, are typically not designed or configured to move sideways along with the gate. Accordingly, as the operating shaft assembly is rotated, the driver is forcibly pulled along in a direction opposed to its natural direction in which the driver moves thereby adding to the forces which must be overcome in moving the gate along its predetermined path of travel.

In the event pneumatic discharge of material is desired, a pan element is positioned underneath the discharge opening and below the gravity gate. Typically, the pan is provided with an open ended outlet tube for discharging the material from the hopper car. The pan is typically fastened to the walled enclosure of the hopper car as with a plurality of fasteners. As will be appreciated, however, valuable time is consumed and lost by having to affix and remove the pan from the hopper car depending upon whether a gravitational discharge mode or a pneumatic mode of discharge is to be used to unload the hopper car. Mounting the pan element beneath or under the gate also reduces the clearance between the bottom of the gate assembly and the railbed over which the car travels between locations. As will be appreciated by those skilled in the art, the degree of clearance between the underside of the gate assembly and the railbed is a serious concern when designing discharge gate assemblies for hopper cars coupled with customer pressures to increase the volumetric payload for the railroad car.

Mounting and arranging the pan element above the sliding gate of the gate assembly has not proven feasible for several reasons. Mounting and arranging the pan element above the sliding gate of the gate assembly has been found to obstruct the flow of material from the walled enclosure in a gravitational mode of material discharge. Mounting the pan element above the gate also presents a problem involving keeping exhaust tubes extending from the pan element clean during loading of the commodity into the hopper car. Furthermore, the moisture in the commodity, tends to cause mold, mildew and other contaminants to be present within outlet tubes leading from the pan element.

The open end of the outlet tube presents still further problems involving railroad hopper car gate assemblies. As will be appreciated, and during transport of the railcar between locations, the outlet tube presents a conduit for directing debris to an interior of the pan assembly. Various devices have been proposed for closing the free open end of such outlet tubes. Such devices, however, often become separated from the outlet tube and are lost. Moreover, the capability of such devices to adequately seal the free open end of the outlet tube is limited. The mechanisms used to secure such known devices to the free end of the outlet tube furthermore add to problems involving timely opening of the discharge tube when pneumatic unloading is the desired means for unloading the railroad hopper car.

Movably mounting a pan element on the frame of the gate assembly beneath the gate introduces significant design problems. First, mounting a pan element for movement beneath the gate requires a second drive mechanism which, most likely, will include another or second operating shaft assembly along with a rack and pinion assembly. As will be appreciated, providing a second drive mechanism for moving the pan element relative to the frame structure of the gate assembly seriously complicates the gate design in several respects. First, the provision of two independently operable drive mechanisms complicates the process for emptying the lading from the hopper car. Second, spacial requirements for the gate assembly, especially when considering the drive mechanism for moving the gate between open and closed positions, is severely restricted. Providing an additional or second drive mechanism on the frame of the gate assembly for moving the pan element between open and closed positions can further adversely effect the clearance required between the gate assembly and the railbed. Of course, if the gate assembly does not provide proper clearance significant damage can result to the gate assembly and the car as the railcar moves between locations. Simply raising the gate assembly, however, reduces the potential volumetric payload capacity of the car while also raising the railcar's center of gravity. Moreover, the addition of a second drive mechanism complicates the direction in which each drive mechanism is to be turned or rotated to effect movement of a particular element on the hopper car gate assembly.

The transportation and unloading of finely divided materials, and particularly food stuffs, such as sugar, flour and the like within and from the walled enclosure of the hopper car exacerbates the problems involved with the design and engineering of a railroad hopper car discharge gate assembly. When the material to be transported involves food stuffs, the FDA has promulgated certain rules and regulations which must be met in order for the hopper car to qualify for transporting foods stuffs. Of course, one of the paramount concerns involved in designing the hopper car discharge gate assembly is that no foreign matter, accumulation of moisture, or insect infiltration is permitted to contact and possibly contaminate the food stuffs even while they are being discharged or unloaded from the hopper car.

When only gravitational discharge of the hopper car carrying food stuffs is to be effected, the frame of the gate assembly or structure is usually provided with a flanged skirt depending from and arranged in surrounding relation relative to an opening defined by the frame of the gate assembly. The flanged skirt defines a discharge plenum. Typically, an air sled or other form of unloading apparatus is clamped to the flange on the skirt during a gravitational discharge operation of food stuffs thereby permitting the food stuffs in the hopper car enclosure to be discharged directly and protectively into the sled and, thus, conveyed away from the hopper car.

To inhibit debris, insects, moisture, clay and other forms of debris from contaminating the underside of the gate and interior of the discharge plenum during transport of the hopper car, such gate assemblies typically include a sanitary plate or cover element positioned beneath the gate to close the discharge plenum and protect the underside of the gate during transport of the hopper car. Of course, known sanitary plates or cover elements are neither designed nor configured to withstand the load which can be placed thereon by the materials within the enclosure of the hopper car.

As they travel between locations, railroad cars are subjected to numerous impact forces, some of which are quite severe. For example, when a railroad car moves down a hump in a classification yard it likely will impact with other railroad cars on the track ahead of it and such impacts can be exceedingly forceful. While shock absorbers are typically built into the coupling units on the railroad cars, still there are sever shock loads within the body of the car and its contents. Of course, when the railroad hopper car is fully loaded, the impact forces are multiplied to even higher levels than with other railroad cars. Such shock loads can affect the position of either gate assembly element, i.e., the slide gate and/or the pan assembly, due to the inertia of either or both elements.

Accordingly, the gate assembly design can furthermore be complicated by requiring a lock assembly for inhibiting the sliding gate from inadvertently moving toward an open position. When the gate assembly embodies a movable pan element underneath the gate, the gate assembly design is furthermore complicated by requiring still another lock assembly for inhibiting inadvertent movement of the pan element toward an open position.

As will be appreciated by those skilled in the art, known slide gate systems can have relatively large gates to effect rapid discharge of materials from the hopper car enclosure. Especially with larger size gates, the column of material above the gate assembly presents a significant downwardly acting force on the gate. This downwardly acting force has been known to cause the gate to bow or curve under the influence of the downwardly acting force. A proper gate assembly design should allow the mechanism used to open the gate to act rapidly and with consistency without requiring an abundant amount of torque to be applied to the drive mechanism to move the gate from a closed position or condition toward an open position or condition.

Thus, there is a continuing need and desire for a hopper car discharge gate assembly which allows for either gravitational or pneumatic unloading of material from the walled enclosure with relatively easy change over thereby adding to the versatility of the hopper car. Moreover, it is desirable to provide a discharge gate assembly having two readily movable elements controlled by separate drive mechanisms while maintaining adequate clearance between a lowermost surface on the gate assembly and the railbed. Additionally, the gate assembly should be designed to provide a lock for each element of the gate assembly thereby inhibiting inadvertent movement of either element toward an open position as a result of impact forces acting on the railroad car. Furthermore, an improved apparatus for closing and sealing the free open end of the outlet tubes used during pneumatic withdrawal of the lading from the hopper car is desired

SUMMARY OF THE INVENTION

In view of the above, one of the salient features of the present invention involves provision of a gate assembly for a railroad hopper car which can be readily and easily conditioned for either pneumatic discharge or gravitational discharge of materials therethrough. The gate assembly of the present invention includes a rigid frame defining a discharge opening and which is provided with a gate or first element slidably carried on the frame for controlling the discharge of material from the hopper car and through the discharge opening. The gate assembly of the present invention is also provided with a second slidable element carried by the frame and extending across the discharge opening. The first and second elements of the gate assembly are arranged in vertically spaced relation relative to each other. In a preferred form, the first and second elements of the gate assembly are disposed in generally parallel relationship relative to each other. A first drive mechanism including a first operating shaft assembly is mounted on the gate frame for slidably moving the first element relative to the frame. A second drive mechanism including a second operating shaft assembly is also mounted on the gate frame for slidably moving the second element relative to the gate frame. One of the salient features of the present invention relates to arranging each of the operating shaft assemblies on the gate frame for rotation about independent axes which are spatially fixed relative to the frame and which are disposed in a substantially common horizontal plane relative to each other. As used herein and throughout, the phrase and term "fixed relative to the frame" means the axis of either operating shaft assembly is neither displaced nor does the spatial relationship of the axis relative to the gate assembly frame change when either operating shaft assembly is operated to move the respective element operably connected thereto relative to the gate assembly frame.

In a preferred form, the frame of the gate assembly preferably has a rectangular configuration. That is, the frame is preferably configured as a four sided rigid structure including a pair of generally parallel side walls extending generally parallel to a longitudinal axis of the railroad car on which the gate assembly is mounted and a pair of end walls rigidly interconnected to the side walls. Preferably, each of the operating shaft assemblies extend generally parallel to an end wall of the frame structure. In a preferred form, the side walls and end walls each define angularly diverging surfaces extending upwardly from the discharge opening toward an upper surface of the frame structure.

The first and second drive mechanism each preferably include a rack and pinion assembly arranged in operable combination with the operating shaft assembly of the respective drive mechanism. Each rack and pinion assembly includes a rack operably associated with a respective element. Pinions mounted on each operating shaft assembly are arranged in intermeshing relationship relative to the racks. Moreover, each rack is movable along a predetermined path of travel concomitantly with movement of the respective element. In a preferred form, the racks of each rack and pinion assembly extend generally parallel to a side wall of the frame structure.

To operate either operating shaft assembly, a driver is typically inserted into operative combination with that operating shaft assembly operably associated with the element on the gate assembly desired to be moved. It is common for such a driver to be telescopically inserted into an appropriately configured drive end opening provide on the operating shaft assembly. The configuration of each drive end opening on the operating shaft assembly, however, can quickly and adversely change as a result of the relatively high impact forces and torque applied thereto by such drivers, thus, requiring repair and/or replacement of the operating shaft assembly.

Accordingly, each operating shaft assembly forming part of the gate assembly of the present invention is preferably of multipiece construction. That is, each operating shaft assembly preferably includes a rotatable shaft and capstans removably attached at opposite ends of the shaft. Such multipiece construction readily allows repair and/or replacement of any component part in a cost efficient and effective manner without having to replace an entire assembly. Such multipiece construction furthermore allows repair and/or replacement of one or more components of the operating shaft assembly without having to remove the entire operating shaft assembly from operable association with the remainder of the gate assembly.

In a preferred form, the axes of the first and second shaft assemblies are mounted to a common vertical side of the predetermined path of travel of the racks. Accordingly, and to simplify operation of the operation of the gate assembly, the operating shaft assemblies operate in the same or common directions to open the first and second elements of the gate assembly and in the same or common direction to close the first and second elements of the gate assembly of the present invention.

To reduce the amount of torque required to be applied to the first and second operating shaft assemblies in moving their respective element relative to the frame, the racks of each rack and pinion assembly are elevationally spaced from that portion of the frame supporting same. In a most preferred form, ultra-high molecular weight polyethylene material is disposed between the racks and the frame to significantly reduce the coefficient of friction therebetween as the first and second elements move between open and closed positions.

The first element of the gate assembly is preferably configured as a generally planar gate which slidably moves in a generally horizontal direction between open and closed positions in response to rotation of the first operating shaft assembly. The second element of the gate assembly is preferably configured as an open top pan assembly having a hood extending thereacross and which is mounted vertically and for generally horizontal movements beneath the gate. The pan assembly defines outlet tubes laterally extending from opposed sides thereof and to which a suction hose or the like is attached to effect pneumatic discharge of materials from the hopper car.

According to another aspect of the present invention, end caps are provided at the open end of each outlet tube of the pan assembly. Unlike heretofore known end cap structures, however, the end caps of the present invention are each affixed to the free ends of the outlet tubes on the pan assembly to advantageously allow for one-handed unlocking/opening and locking/closing of the end cap relative to the outlet tube or discharge outlet. A gasket or seal is preferably arranged in combination with the end cap and the outlet tube on the pan assembly to furthermore inhibit passage of contaminants and moisture into the material receiving portion or chamber of the pan assembly. To provide a substantially equally distributed force against the gasket as the end cap or cover is moved to the closed position, cams are preferably arranged in combination with each end cap thereby enhancing closure of the end cap relative to the outlet tube on the pan assembly.

In a preferred form, the racks of the rack and pinion assemblies arranged in operative combination with the gate and pan assembly are each disposed to opposed lateral sides of the gate and pan assembly in locations outwardly removed from beneath the discharge opening. In a most preferred form of the invention, the racks of each rack and pinion assembly are arranged outside or to opposed lateral sides of the discharge opening defined by the frame structure of the gate assembly. This preferred gate assembly design readily lends itself to improved sealing capabilities between the gate as well as the pan assembly and the frame structure thereby inhibiting debris and moisture from contaminating the materials held and transported within the hopper car.

As will be appreciated by those skilled in the art, a significant weight is applied to the gate extending across the discharge opening by the materials maintained and transported within the hopper car. The weight of such materials often causes distortion of the gate which complicates sliding of the gate, at least, between closed and open positions. In view of the above, a preferred form of the present invention contemplates providing a stationary support across the discharge opening for inhibiting the gate from bending beyond a predetermined limit. As with the racks of the gate assembly, in a preferred embodiment, ultra-high molecular weight polyethylene material is disposed between the support and the undersurface of the gate to promote sliding movements therebetween. A stationary deflector or hood including angularly diverging sides is also provided above the discharge opening defined by the frame assembly to address the significant weight provided by the lading in the hopper car pressing downwardly onto an upper surface of the gate.

A preferred design of the present invention furthermore embodies a tamper seal arrangement allowing for application of a tamper seal in combination with the gate assembly. As is conventional, the tamper seal, when arranged in combination with the gate assembly, readily provides a visual indication of whether the gate has been moved to provide unauthorized access to the materials contained within the hopper car.

To address the problems and concerns associated with inadvertent movements of the gate assembly elements relative to the frame structure, a preferred embodiment of the gate assembly further includes a lock assembly. The lock assembly associated with the gate assembly of the present invention includes a lock which, when the gate is in a closed position, inhibits inadvertent movement of the gate toward an open position. A preferred embodiment of the lock assembly further includes a second lock which, when the pan assembly is in a closed position, inhibits inadvertent movement of the pan assembly toward an open position. In a most preferred form of the invention, both the lock for maintaining the door in a closed position and the lock for maintaining the pan assembly in a closed position are incorporated into a single mechanism, thus, eliminating the need for and operation of two separate lock assemblies.

When the gate assembly of the present invention is mounted to a railroad hopper car, the design advantageously allows for either pneumatic discharge or gravitational discharge of material from the hopper car. As a commodity filled railcar travels between locations and then is parked waiting to be unloaded, the lock assembly ensures the gate and the pan assembly will remain in their closed condition even though significant impacts may be applied to the railcar as it travels or awaits discharge of the materials therefrom.

Arranging the first and second operating shaft assemblies for the two movable elements of the gate assembly for rotation about axes which are fixed relative to the frame and in horizontally adjacent relation relative to each other offers several meritorious design advantages. The arrangement of the operating shaft assemblies according to the present invention minimizes the vertical distance or height between the upper attaching surface of the gate assembly and the lowermost surface of the pan assembly while retaining an adequate angle on the sidewalls and end walls to assure materials discharge from the hopper car and through the discharge opening. Of course, minimizing the distance the gate assembly depends from the hopper car allows added clearance beneath the hopper car while allowing for greater volumetric payload capacity. Furthermore, arranging each operating shaft assembly to rotate about an axis which is fixed relative to the frame eliminates cumbersome, longitudinal readjustment of the powered drivers which are common at unloading sites across the country.

Another object accomplished by a preferred form of the present invention relates to operating the operating shaft assemblies in a common direction to open and close the elements operably associated with each operating shaft assembly, thus, reducing human operator confusion of open and closure directions.

Another object of the present invention involves providing a railroad hopper car gate assembly having two elements which are independently movable between open and closed positions through operation of independently operable shaft assemblies, each of which rotates about an axis which is fixed relative to the frame, thereby advantageously permitting an operator to independently operate the gate elements while concurrently validating cleanliness of the commodity contacting surface areas on the elements as they move between positions.

Still another object of this invention is to simplify operation of the end cap or cover associated with the discharge port of the open top pan assembly.

Another object of this invention is to provide a closure cap assembly for the pan assembly which provides a substantially equally distributed force to the seal or gasket used in combination therewith as the closure cap moves toward the closed position.

These and other objects, aims and advantages of the present invention will be readily and quickly appreciated from the following detailed description, appended claims, and drawings.

DETAILED DESCRIPTION OF THE DRAWINGS

FIG. 19 is a fragmentary perspective view of one form of closure assembly operable in combination with an outlet tube of an open top pan assembly;

FIG. 20 is an enlarged end view of the closure assembly illustrated in FIG. 19;

DETAILED DESCRIPTION OF THE PRESENT INVENTION

Figure 1:
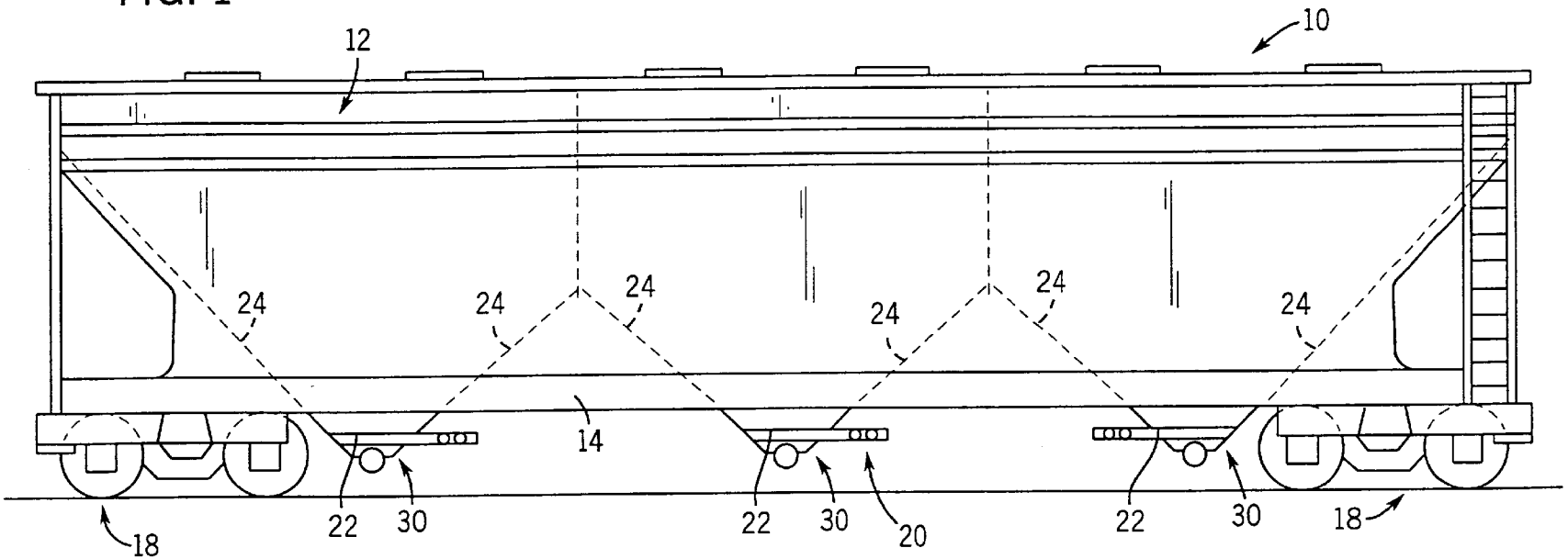
FIG. 1 is a side elevational view of a railroad hopper car equipped with a gate assembly embodying principals of the present invention.

While the present invention is susceptible of embodiment in various forms, there is shown in the drawings and will hereinafter be described in detail preferred embodiments of the invention with the understanding the present disclosure is to be considered as setting forth exemplifications of the invention which are not intended to limit the invention to the specific embodiments illustrated.

Referring now to the drawings, wherein like reference numerals indicate like parts throughout the several views, a railroad hopper car, equipped with a gate assembly according to the present invention, is illustrated in FIG. 1. The railroad hopper car, generally designated by reference numeral 10, includes a multiwalled enclosure 12 for storing and transporting particulate materials, i.e. flour, sugar, etc., therewithin. As known in the art, the multiwalled enclosure 12 is supported on an underframe 14 extending generally the length of the car 10. As is typical, the underframe 14 is supported toward opposite ends thereof by conventional wheeled trucks, generally designated by reference numeral 18.

As illustrated, a bottom 20 of the enclosure 12 is provided with a plurality of opening 22 for allowing the materials to be discharged from within the enclosure 12. As will be appreciated, more or fewer openings than that shown for exemplary purposes can be readily provided without detracting or departing from the true spirit and novel concept of the present invention. As shown, the enclosure 12 of hopper car 10 includes a plurality of slope sheets 24 funneling downwardly toward each opening 22 in the bottom 20 of the hopper car 10 to promote the discharge of materials therefrom.

Figure 2:
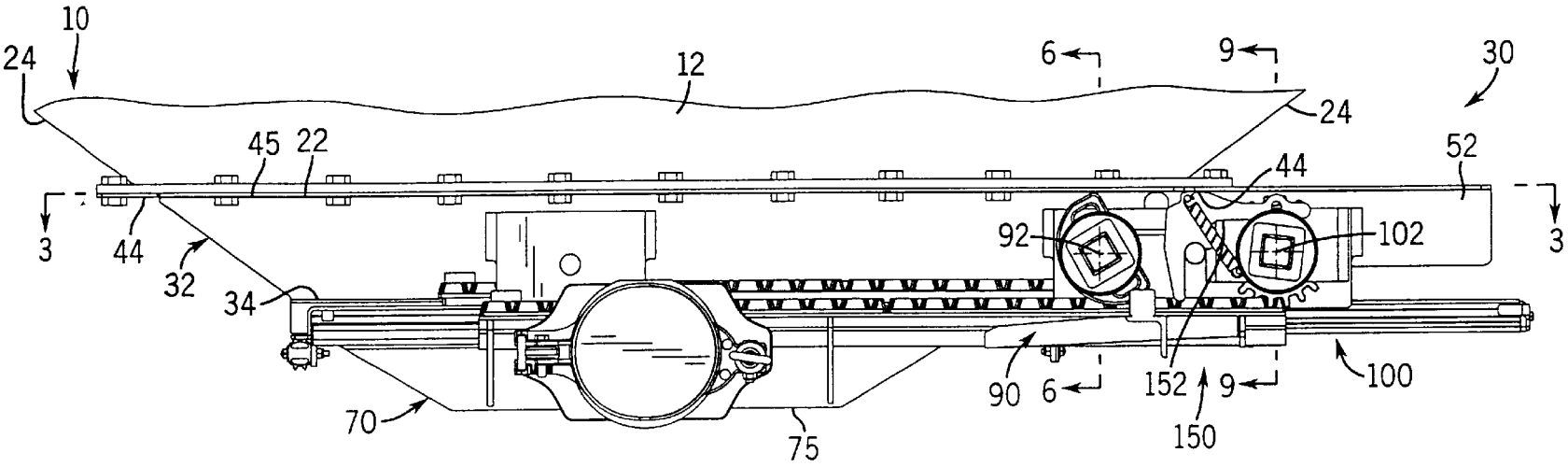
FIG. 2 is a side elevational view of the gate assembly of the present invention.
Figure 3:
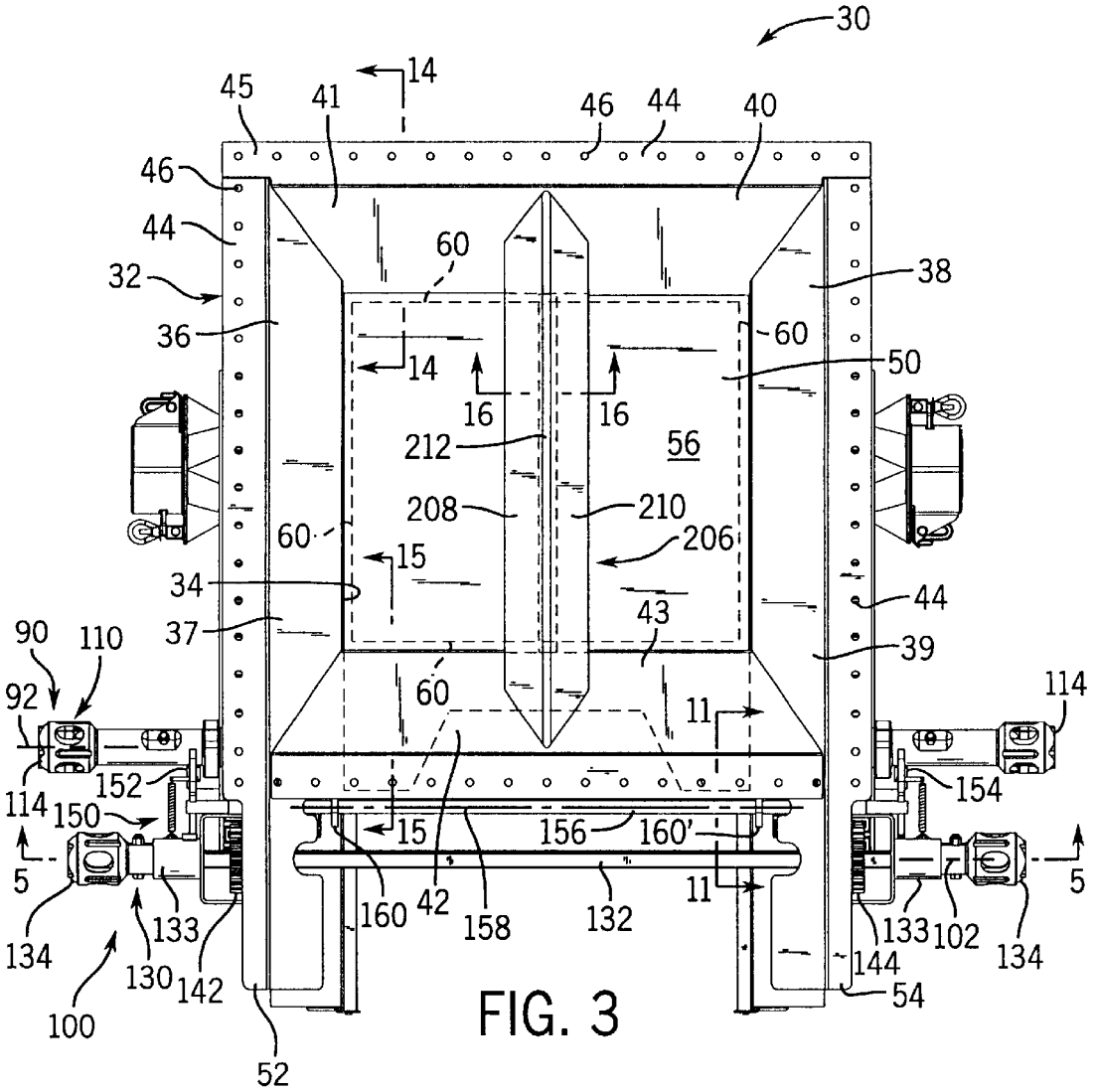
FIG. 3 is a sectional view of the gate assembly taken along line 3—3 of FIG. 2.

A gate assembly, generally designated by reference numeral 30 in FIGS. 1 and 2, is shown arranged in combination with each opening 22 along the bottom 20 of the hopper car 10. Since the gate assemblies 30 arranged along the bottom 20 of the car 10 are substantially identical relative to each other, only one gate assembly will be described in detail. As illustrated in FIGS. 2 and 3, each gate assembly 30 includes a rigid frame 32 defining a discharge opening 34. The frame 32 of gate assembly 30 is preferably fabricated from FDA approved materials in all material contacting areas to allow the hopper car 10 to hold and transport food grade materials and eliminate lining requirements which is an FDA approved coating. Notably, when the gate assembly 30 is attached or otherwise connected to the walled enclosure 12 of the hopper car 10 (FIG. 2), the discharge opening 34 defined by frame 32 is arranged in registry with a respective opening 22 (FIGS. 1 and 2) in the walled enclosure 12 of hopper car 10.

As shown in FIG. 3, frame 32 includes opposed and generally parallel side walls 36, 38 extending lengthwise of the hopper car 10 and opposed end walls 40, 42 extending transversely across the hopper car 10. In the illustrated form, the disposition of the side walls 36, 38 and end walls 40, 42 is such that a trapezoidal or rectangular shape is provided for the discharge opening 34. To promote movement of materials, and as is conventional, the side walls 36 and 38 of frame 32 are preferably provided with diverging angular surfaces 37 and 39, respectively, extending upwardly from the discharge opening 34 and toward an upper surface of frame 32. Similarly, and as is conventional, the end walls 40 and 42 of frame 32 are preferably provided with diverging angular surfaces 41 and 43, respectively, extending upwardly from the discharge opening 34 and toward an upper surface 45 of frame 32.

Figure 6:
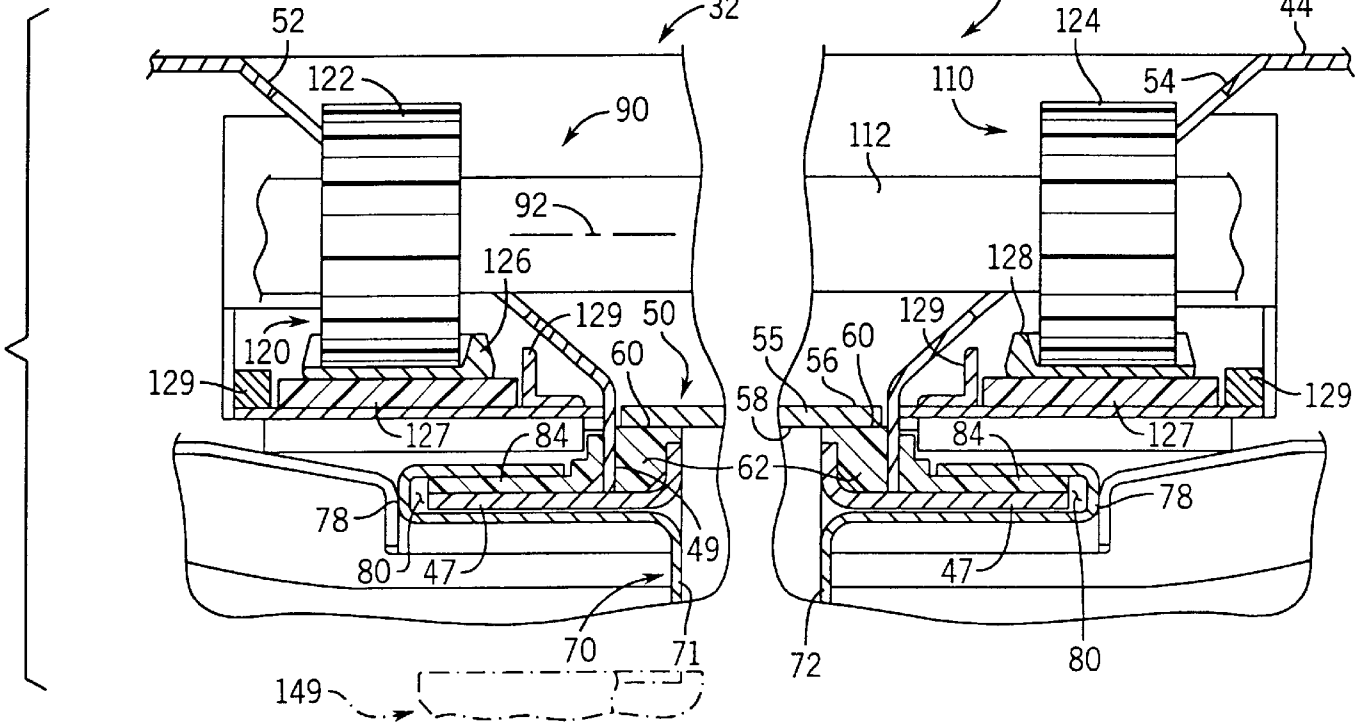
FIG. 6 is a fragmentary sectional view taken along line 6—6 of FIG. 2.
Figure 14:
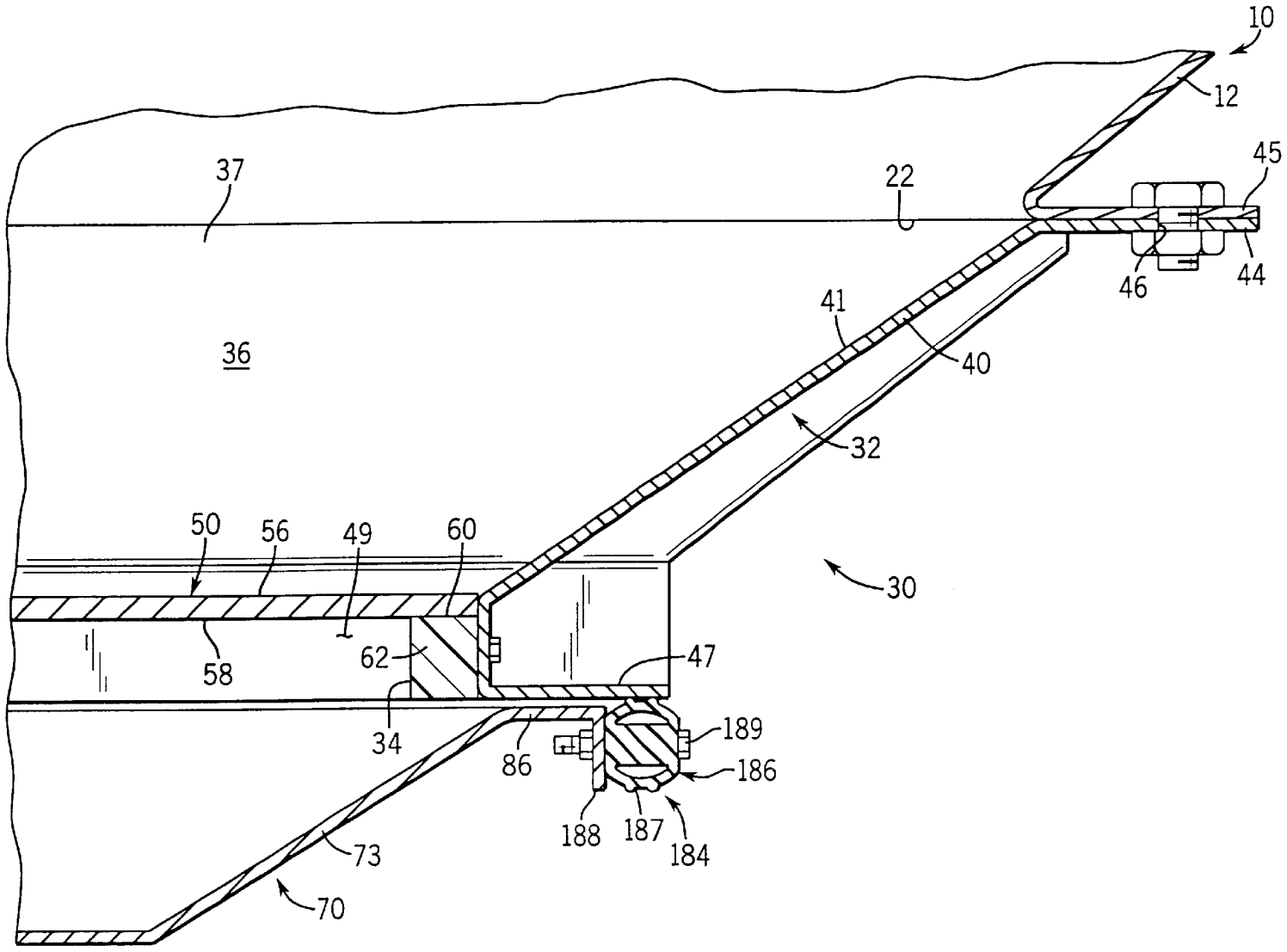
FIG. 14 is an enlarged sectional view taken along line 14—14 of FIG. 3.

As well known in the art, and as illustrated in FIG. 3, each side wall 36, 38 and end wall 40, 42 has a mounting flange 44 arranged in generally planar relation relative to each other and which define the upper surface 45 of the gate assembly 30. As illustrated in FIG. 2, the flanges 44, arranged toward the upper end of the walls 36 through 42, are configured to mate with respective portions of the hopper car 10 to facilitate attachment of the gate assembly to the hopper car 10. In one form, the flanges 44 define spaced holes 46 allowing for passage of suitable fasteners, such as threaded bolts, therethrough. Of course, other suitable means of attaching the frame 32 of the gate assembly 30 to respective portions of the hopper car enclosure 10, i.e. welding or the like, are equally applicable. As illustrated in FIGS. 6 and 14, a lower end of the walls 36 through 42 of gate frame 32 extends beneath the gate 50 to define a discharge plenum 49 preferably depending from the discharge opening 34 defined by gate frame 32. As furthermore illustrated in FIGS. 6 and 14, a lower end of the walls 36 through 42 of gate frame 32 terminates in an outwardly extending generally horizontal flange 47.

Figure 4:
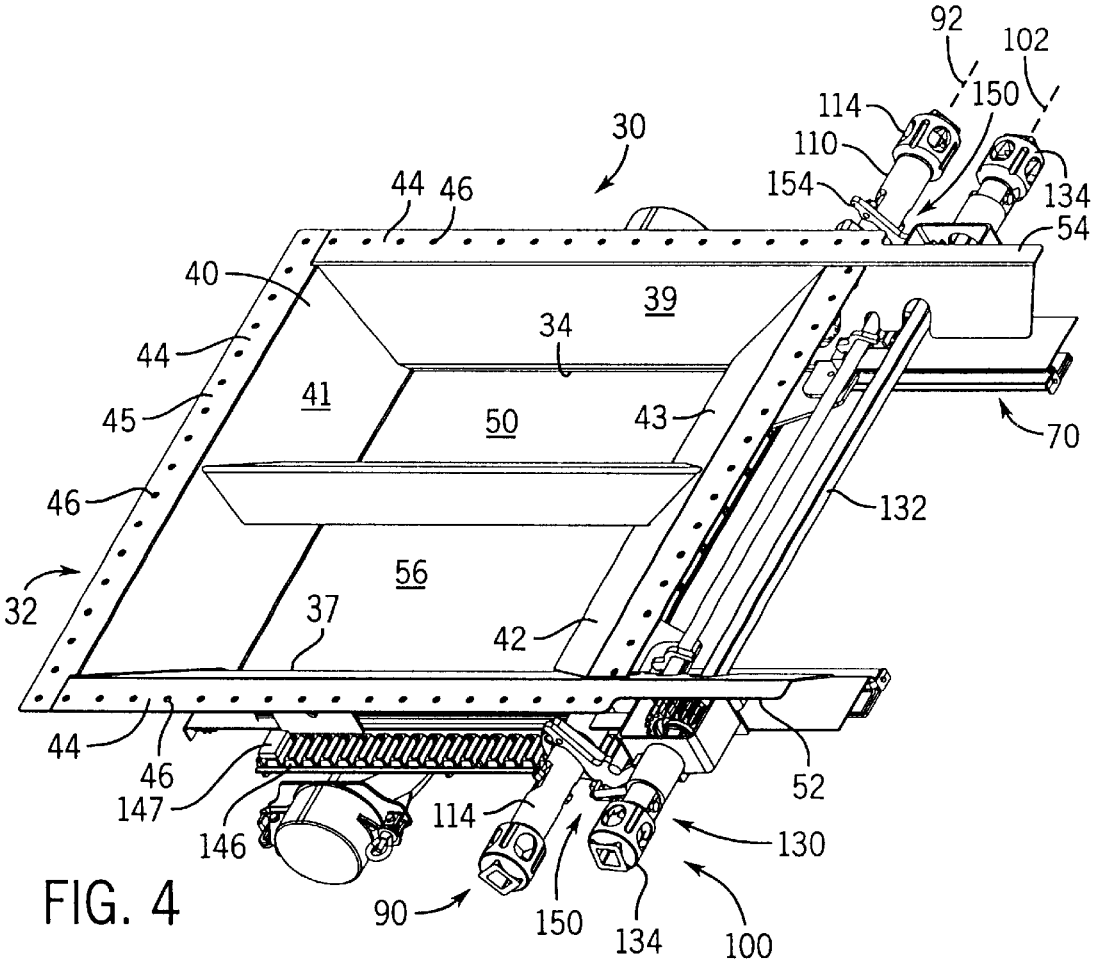
FIG. 4 is a perspective view of the gate assembly of the present invention.

As shown in FIGS. 3 and 4, the gate assembly 30 of the present invention is furthermore provided with a gate or first element 50 mounted on the frame 32 for sliding movement along a predetermined path of travel. In a closed position, the gate or element 50 extends across and thereby selectively closes the discharge opening 34 defined by the frame 32. As will be appreciated, however, the gate or element 50 is movable relative to the frame 32 and the discharge opening 34 to an open position to allow commodity to pass from the enclosure 12 and through the discharge opening 34. In the illustrated embodiment, frame 32 is provided with parallel frame extensions 52 and 54 extending lengthwise of the hopper car 10 and away from the end wall 42 of frame 32.

Figure 5:
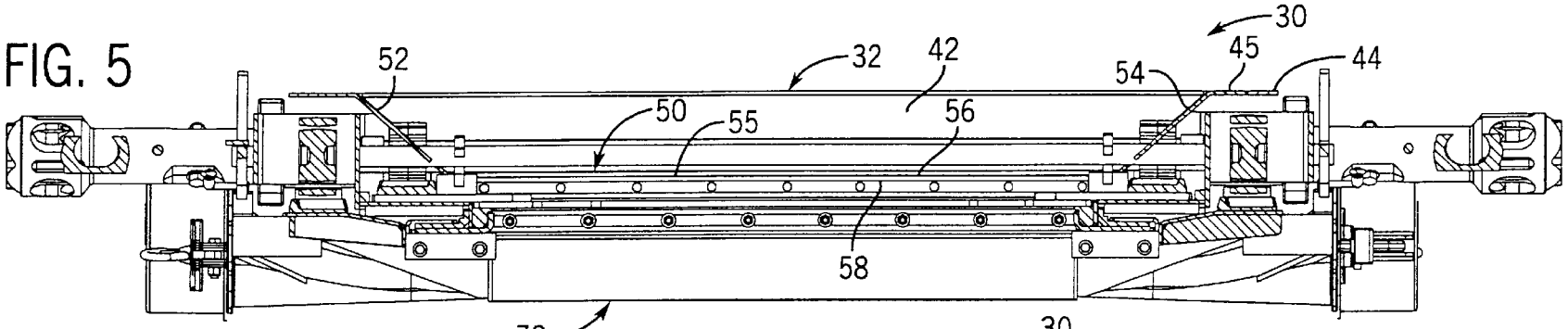
FIG. 5 is a sectional view taken along line 5—5 of FIG. 3.
Figure 7:
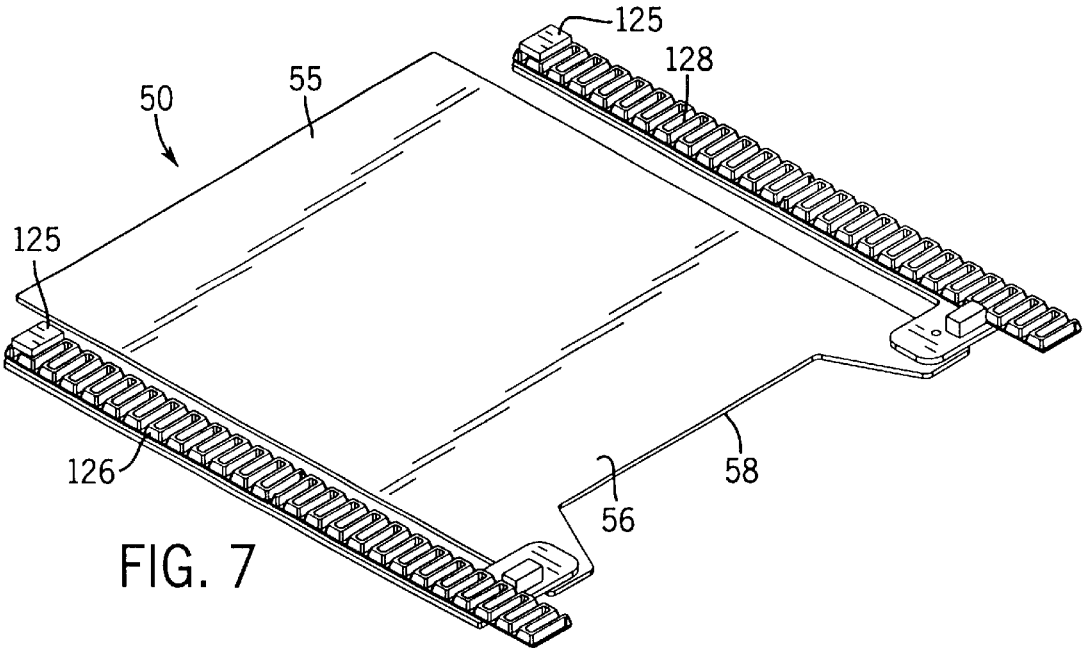
FIG. 7 is a top left side perspective view of a gate forming part of the gate assembly of the present invention.

As shown in FIGS. 5, 6 and 7, the gate 50 of gate assembly 30 is configured as a rigid flat plate 55 including upper and lower surfaces 56 and 58, respectively. In the illustrated embodiment, gate 50 has a generally rectangular configuration. To promote use of the gate assembly 30 in combination with food grade commodities, gate 50 is preferably fabricated from an FDA approved material such as stainless steel.

Returning to FIG. 3, the side walls 36, 38 and end walls 40, 42 of the frame 32 are each provided with a horizontally disposed ledge 60 which underlies and supports the gate 50. In a most preferred form, and as shown in FIG. 6, each ledge 60 includes material 62 to prevent galling of the stainless steel of gate 50 in contact with the stainless steel of the frame 32. In a most preferred form, an ultra-high molecular weight material is used and acts as shield between the lower surface 58 of the gate 50 and the frame 32. As will be appreciated, and when material 62 is formed from an ultra-high weight molecular material, such material furthermore reduces the coefficient of friction between the gate 50 and the frame 32 as the gate 50 moves relative to the frame 32.

As illustrated in FIGS. 2, 4 and 5, gate assembly 30 furthermore includes a second element 70 carried on the frame 32 in vertically spaced relation relative to the gate 50. In the preferred embodiment, element 70 is disposed for generally parallel movement relative to the first element or gate 50. It is possible, however, to arrange the first element 50 and second element 70 in vertically spaced but non-parallel arrangement without detracting or departing from the spirit and novel concept of the present invention. Like the first element or gate 50, the second element 70 likewise extends across the discharge opening 34 defined by the frame 32 and is mounted for sliding movement between open and closed positions. As will be appreciated, in the closed position, the second element 70 extends across the discharge opening 34 defined by the frame 32 while in an open position, the second element 70 is removed from beneath the opening 34 defined by the frame 32 of the gate assembly 30.

The second element 70 of the gate assembly 30 is preferably configured as an open top vacuum pan assembly arranged on the frame 32 for sliding movement along a predetermined path of travel and beneath the gate 50. The open top pan assembly 70 is preferably fabricated from FDA approved material such as stainless steel or the like whereby promoting use of the gate assembly 30 in combination with food grade materials.

Figure 8:
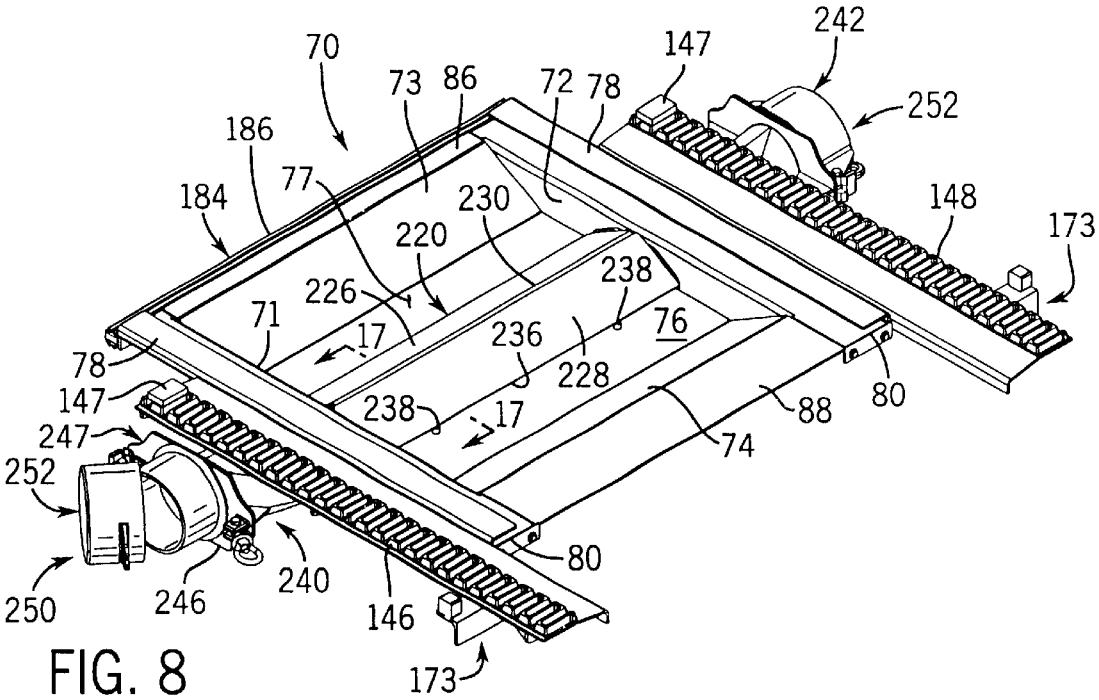
FIG. 8 is a top left side perspective view of a pan assembly forming part of the gate assembly of the present invention.

The open top pan assembly 70 is used in combination with the gate assembly 30 for effecting pneumatic discharge of commodity from the enclosure 12 (FIG. 1) of the hopper car 10. As shown in FIG. 8, the open top pan assembly 70 is preferably configured with two generally vertical and laterally spaced side walls 71, 72, two slanting end walls 73, 74 rigidly joined to the side walls 71, 72, and a generally flat bottom 76 interconnected to all the walls 71 through 74. As will be appreciated from an understanding of the pan assembly 70, and in combination relative to each other, the walls 71 through 74, along with the bottom 76 define an open top plenum chamber 77 disposed directly beneath the discharge opening 34 defined by frame 32 of the gate assembly 30 when the pan assembly 70 is in the closed position. The exterior side of the flat bottom 76 defines a bottom or lower surface 75 (FIG. 2) for the gate assembly 30. As shown in FIGS. 4 and 8, the upper edges of the side walls 71 and 72 are configured to form mounting flanges 78 which define open sided channels 80.

As illustrated in FIG. 6, when the pan assembly 70 is mounted for sliding movement on the frame 32 of the gate assembly 30, the open sided channels 80 defined by the mounting flanges 78 are arranged in operable combination with the flange-like generally horizontal projections 47 extending along the length of the side walls 36, 38 of the gate frame 32 to allow for fore-and-aft sliding movements of the pan assembly or second element 70 along a predetermined path of travel between open and closed positions beneath the gate 50. To enhance sliding movements of the pan assembly 70 relative to the frame 32 of the gate assembly 30, and to effectively seal the slides of the pan assembly 70 to the frame 32 thereby inhibiting passage of debris therepast, ultra-high molecular weight polyethylene material 84 (FIG. 6) is preferably disposed between the rails 82 and the open sided channel 80 on the pan assembly 70. In the illustrated form in FIG. 8, the upper edges of the end walls 73 and 74 are each bent to project in a fore-and-aft direction to form flanges 86 and 88, respectively. In a preferred form, the flange 86 projecting from the respective end wall 73 of the pan assembly 70 is arranged generally parallel to but below the flange-like structure 47 (FIG. 14) projecting away from the opening 34 and provided on the lower end of the end wall 40 of the frame 32 of the gate assembly 30.

Returning to FIGS. 2 and 3, gate assembly 30 further includes a first drive mechanism 90 and a second drive mechanism 100 for selectively moving the first element or gate 50 (FIG. 3) and the second element or pan assembly 70 (FIG. 2), respectively, relative to the frame 32 of the gate assembly 30. Drive mechanism 90 is carried on the frame 32 for rotation about an axis 92 which is fixed relative to the frame 32 and which extends generally parallel to the end wall 42 of the frame 32. Drive mechanism 100 is carried on the frame 32 for rotation about an axis 102 which is fixed relative to the frame 32 and which extends generally parallel to axis 92 and to the end wall 42 of the frame 32.

Figure 10:
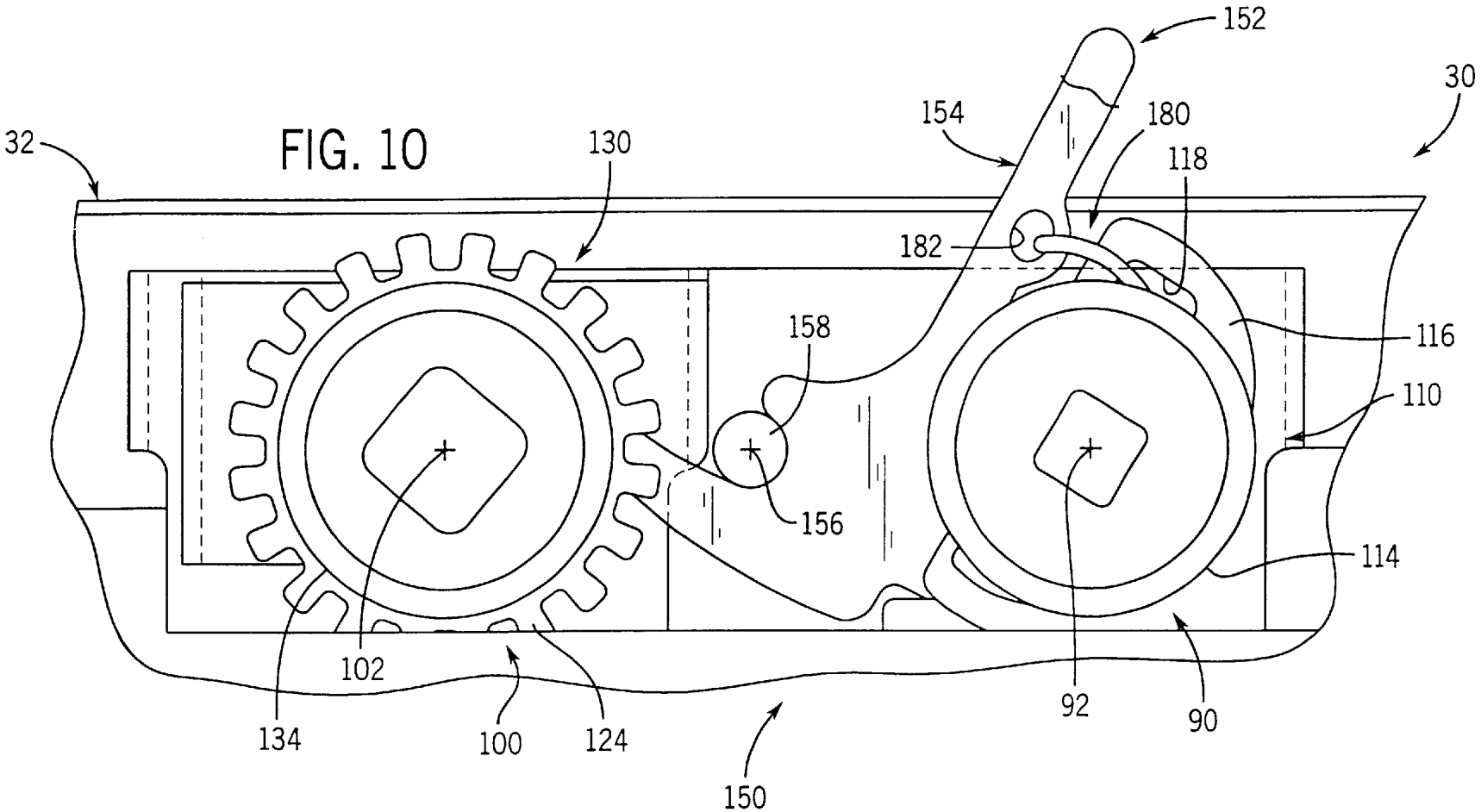
FIG. 10 is an enlarged fragmentary side elevational view of a portion of a drive mechanism forming part of the gate assembly.

One of the salient features of the present invention relates to mounting the first and second drive mechanisms 90 and 100 in horizontally adjacent relation relative to each other thereby minimizing the distance separating the upper surface 45 and the lower surface 75 (FIG. 2) of the gate assembly 30 while maximizing the vertical spacing between the bottom 76 of the pan assembly 70 and the ground or railbed over which the gate assembly 30 travels as the railroad car 10 on which the gate assembly 30 is mounted moves between locations. It is important to note, the fixed axes 92 and 102 of drive mechanisms 90 and 100, respectively, are furthermore disposed in vertically adjacent relationship relative to each other. That is, in a preferred embodiment of the invention, and as illustrated in FIG. 10, the fixed axes 92 and 102 of drive mechanisms 90 and 100, respectively, are disposed in a substantially or generally common horizontal plane relative to each other. The phrase "substantially or generally common horizontal plane relative to each other" means the axes 92 and 102 are preferably disposed, within practical limits, a like vertical distance from a common horizontal surface of the gate assembly 30. In the embodiment illustrated in FIG. 10, the practical vertical distance separating the axes 92 and 102 is reduced to beneficially minimize the height of the gate assembly 30 thereby maximizing the payload capacity of the car 10 while concurrently maintaining sufficient clearance between the bottom 76 of the gate assembly 30 and the railbed. Additionally, it is beneficial to minimize the horizontal distance separating the axes 92 and 102 of the drive mechanisms 90 and 100, respectively, relative to the mounting flange 44 on the adjacent end wall 42 of the gate frame 32 thereby promoting transference of imparted torsional opening forces to the car 10.

As illustrated in FIG. 6, drive mechanism 90 preferably includes an elongated operating shaft assembly 110 which is supported by the frame 32 of the gate assembly 30 for rotation about the axis 92 which is fixed relative to the frame 32. Notably, the fixed axis 92 about which the operating shaft 110 turns is disposed to one vertical side of the gate 50. In the illustrated form, the fixed axis 92 about which the operating shaft assembly 110 turns is vertically spaced above the upper surface 56 of the gate 50. The operating shaft assembly 110 is preferably of multi-piece construction and includes an elongated operating shaft 112 (FIG. 6) having capstans or operating handles 114 (FIGS. 3 and 4) releasably affixed to opposed ends thereof Preferably, the operating shaft 112 has a square cross-sectional area. From an understanding of what follows, it will be appreciated other cross sectional configurations for shaft 112 would equally suffice without detracting or departing from the spirit and scope of the present invention. In the illustrated form, the operating shaft assembly 110 is supported for rotation by the frame extensions 52, 54 (FIG. 3) of the frame 32. (FIG. 3) of the frame 32.

As shown in FIG. 6, drive mechanism 90 further includes a rack and pinion assembly 120 arranged in operable combination with the operating shaft assembly 110. The purpose of the rack and pinion assembly 120 is to convert the rotary movement of the operating shaft assembly 110 about axis 92 into linear fore-and-aft movement of the gate 50 relative to the frame 32 depending upon the direction of rotation of the operating shaft assembly 110.

As shown in FIG. 6, the rack and pinion assembly 120 preferably includes a pair of laterally spaced pinions 122 and 124 mounted on and for rotation with the operating shaft 112 of operating shaft assembly 110. The pinions 122, 124 are arranged in intermeshing relation with a pair of elongated racks or toothed tracks 126 and 128. Each pinion 122, 124 preferably has a centralized throughbore or opening the cross-section of which generally corresponds to the cross-section of the operating shaft 112 whereby allowing each pinion 122, 124 of the rack and pinion assembly 120 to axially move, within defined limits, along the length of the operating shaft 112. So as to limit the axial movement of the pinions 122, 124 along the length of shaft 112, thereby eliminating the need for fasteners or the like, each rack or toothed track 126, 128 is preferably configured with a serpentine design similar to that disclosed in my copending U.S. design patent application Ser. No. 29/100,863 filed Feb. 19, 1999.

The racks or toothed tracks 126, 128 of the rack and pinion assembly 120 are preferably fastened to and move concomitantly with the gate or first element 50 of the gate assembly 30. Returning to FIG. 7, a stop 125 is provided at the distal end of each rack 126, 128. The purpose of stop 125 is to limit endwise travel or movement of the first element or gate 50 relative to the frame 32 of the gate assembly 30. The racks 126, 128 of the rack and pinion assembly 120 extend generally parallel to opposed sides of the gate 50 and generally parallel to opposed side walls 36, 38 of frame 32. Notably, when the gate 50 is mounted for sliding movement on the frame 32 the racks 126, 128 of the rack and pinion assembly 120 are carried and supported by the frame 32 in laterally spaced outward relation from opposed side edges of the gate 50 for endwise sliding movement along a predetermined path of travel relative to the frame 32. As such, the racks 126, 128 are disposed outwardly from and to opposed sides of the discharge opening 34 defined by the frame 32. As illustrated in FIG. 6, lateral or sideways movements of the racks 126, 128 is limited by guides 129 affixed to the frame on opposite lateral sides of each rack 122, 124.

In a most preferred form, and as shown in FIG. 6, each rack 126, 128 of the rack and pinion assembly 120 is disposed in elevated relation relative to an underlying portion of the frame 32 for effectively lowering the coefficient of friction between the racks 126, 128 operably associated with the first element 50 of the gate assembly 30 and the frame 32. Several alternative designs could be used to vertically separate the racks 126, 128 from the frame 32 of the gate assembly 30. In the illustrated embodiment, a partially crystalline lightweight thermoplastic material such as ultra-high molecular weight polyethylene material 127 is entrapped between an underside of the racks 126, 128 and the frame 32 of the gate assembly 30 thereby significantly reducing the coefficient of friction therebetween and, thus, enhancing sliding movements of the racks 126, 128 and thereby the first element or gate 50 relative to the frame 32.

Figure 9:
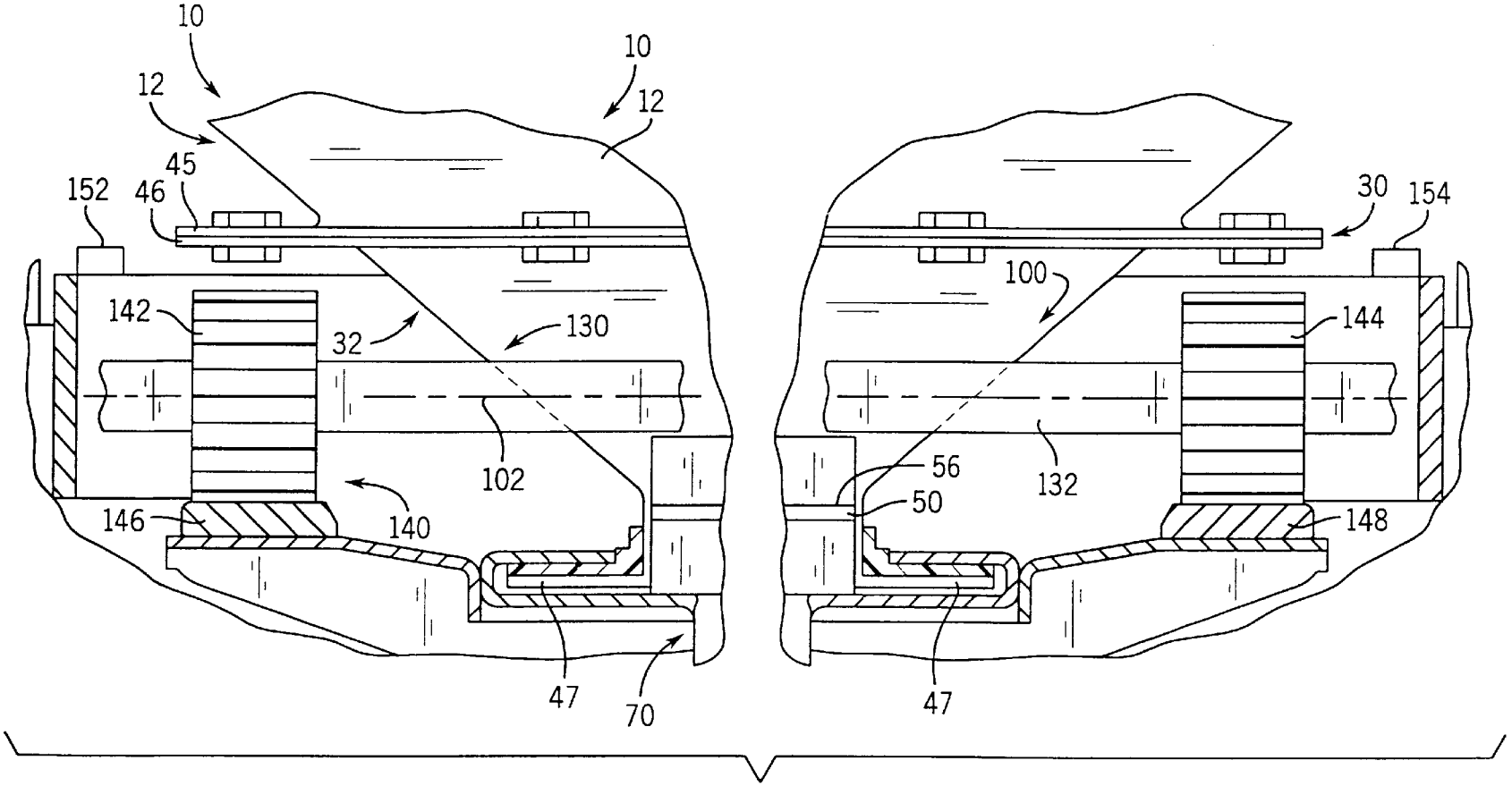
FIG. 9 is a fragmentary sectional view taken along line 9—9 of FIG. 2.

As illustrated in FIGS. 3 and 9, drive mechanism 100 includes and elongated operating shaft assembly 130 which is supported by the frame 32 of the gate assembly 30 for rotation about the axis 102 which is fixed relative to the frame 32. Another salient feature of the present invention concerns a gate design embodying two drive mechanisms 90, 100 (FIG. 3) and wherein the operating shaft assemblies 110 and 130 of the two drive mechanisms 90 and 100, respectively, turn in the same direction to effect opening and closing movements of the respective elements associated therewith.

To effect such desirous ends, the fixed axis 102 about which the operating shaft 130 turns is disposed to one vertical side of the gate 50. In the illustrated form, the fixed axis 102 about which the operating shaft assembly 130 turns is disposed to the same side of the gate 50 as is axis 92 of operating shaft assembly 100 (FIG. 6). That is, the fixed axis 102 about which the operating shaft assembly 130 turns is vertically spaced above the upper surface 56 of the gate 50. In the illustrated embodiment, and as shown in FIG. 10, the fixed axis 92 about which the operating shaft 110 turns and the fixed axis 102 about which the operating shaft 130 turns are disposed a substantially equivalent vertical distance from the upper surface 45 of the frame structure 32 of the gate assembly 30. As will be appreciated, and although they are "substantially equivalent" the vertical distances of the fixed axes 92 and 102 relative to the upper surface 45 of the gate assembly 30 can vary relative to each other within practical limits but such differences are minimized to optimize the vertical clearance between the lower surface of the gate assembly 30 and the railbed over which the railroad car with the gate assembly attached thereto moves.

As shown in FIG. 9, drive mechanism 100 further includes a rack and pinion assembly 140 arranged in operable combination with the operating shaft assembly 130. The purpose of the rack and pinion assembly 140 is to convert the rotary movement of the operating shaft assembly 130 about axis 102 into linear fore-and-aft movement of the second element or pan assembly 70 relative to the frame 32 depending upon the direction of rotation of the operating shaft assembly 130.

As shown in FIG. 9, the rack and pinion assembly 140 preferably includes a pair of laterally spaced pinions 142 and 144 mounted on and for rotation with the operating shaft 132 of operating shaft assembly 130. The pinions 142, 144 are arranged in intermeshing relation with a pair of elongated racks or toothed tracks 146 and 148. Each pinion 142, 144 preferably has a centralized throughbore or opening the cross-section of which generally corresponds to the cross-section of the operating shaft 132 whereby allowing each pinion 142, 144 of the rack and pinion assembly 140 to axially move, within defined limits, along the length of the operating shaft 132. So as to limit the axial movement of the pinions 142, 144 along the length of shaft 132, thereby eliminating the need for fasteners or the like, each rack or toothed track 146, 148 is preferably configured with a serpentine design similar to that disclosed in my copending U.S. design patent application Ser. No. 29/100,863 filed Feb. 19, 1999.

As mentioned above, in the exemplary embodiment of gate assembly 30, elements 50 and 70 are vertically separated from each other. In a most preferred embodiment, element 70 is vertically disposed beneath element 50. Because the elements 50 and 70 are elevationally separated, the pinions 142, 144 of assembly 140 have a larger diameter than pinions 122, 124 of assembly 120 to help minimize the vertical distance separating the axes 92 and 102 of drive mechanisms 90 and 100, respectively, relative to each other.

The racks or toothed tracks 146, 148 of the rack and pinion assembly 120 are preferably fastened to and move concomitantly with the pan assembly or second element 70 of the gate assembly 30. Returning to FIG. 8, a limit stop 147 is provided at the distal end of each rack 146, 148. The purpose of stop 147 is to limit endwise travel or movement of the second element or pan assembly 70 relative to the frame 32 of the gate assembly 30.

Suffice it to say, when element or pan assembly 70 is in a fully opened position (when the pinions 142,144 engage the limit stop 147), element or pan assembly 70 is removed from beneath the flanges 47 on the gate frame 32 as to permit a conventional discharge apparatus 149 (schematically and only partially represented in phantom lines in FIG. 6) to be coupled or otherwise releasably secured beneath the discharge plenum 49 defined by the gate frame 32. The discharge apparatus 149 (also commonly referred to as an air sled) may be of the type disclosed in one or more of the following U.S. Pat. Nos. 2,376,814; 2,517,837; 2,527,455; 2,527,466; 2,589,968; 2,657,100; 2,675,274; 2,681,748; or 2,789,739. Alternatively, the discharge apparatus 149 which is releasably coupled to the gate assembly 30 beneath and in material receiving relation relative to the discharge plenum 49 may be a simple compression boot or chamber that draws commodity from the discharge opening 34 toward a storage reservoir (not shown)

As shown in FIG. 8, the racks 146, 148 of the rack and pinion assembly 120 extend generally parallel to the opposed side walls 71, 72 of the pan assembly 70. Notably, when the pan assembly 70 is mounted for sliding movement on the frame 32, the racks 142, 144 of the rack and pinion assembly 140 are carried and supported by the frame 32 in laterally spaced outward relation from opposed side walls 71, 72 of the pan assembly 70 for endwise sliding movement along a predetermined path of travel relative to the frame 32. As such, the racks 146, 148 are disposed outwardly from and to opposed sides of both the plenum 49 defined by the gate frame 32 and the plenum 77 defined by the pan assembly 70.

Another salient feature of the present invention relates to the provision of a single lock mechanism 150 for controlling movements of both the first element or gate 50 (FIG. 3) and the second element or pan assembly 70 (FIG. 4) relative to the frame 32. As illustrated in FIG. 3, lock mechanism 150 preferably includes pair of operating handles 152 and 154 arranged laterally outward from the frame extensions 52, 54 on frame 32 on opposite sides of the gate assembly 30 for ready manual access and which are supported for rotation about a fixed axis 156 defined by a rockshaft 158. As illustrated in FIG. 10, axis 156 is disposed between and extends generally parallel to axes 92 and 102 of drive mechanisms 90 and 100, respectively. The rockshaft 158 is preferably supported for rotation by the frame extensions 52, 54 of frame 32.

The lock mechanism 150 inhibits inadvertent movement of the gate or first element 50 toward the open position and further includes at least one cam locking member 160. In a preferred form, the lock mechanism 150 includes a pair of cam locking members 160 and 160' (FIG. 3) which rotate in unison with the rockshaft 158. The cam locking members 160, 160' are arranged in axially spaced relation along the length of the rockshaft 158 and between the lower edges of the frame extensions 52, 54 of frame 32 for engagement with a portion of the gate 50. In the illustrated embodiment, the cam locking members 160, 160' and their relationship relative to the upper surface 56 of gate 50 are visibly apparent to an operator of the gate assembly 30 and thereby the condition of the lock mechanism 150 is likewise visibly apparent to the operator of the gate assembly 30.

Figure 11:
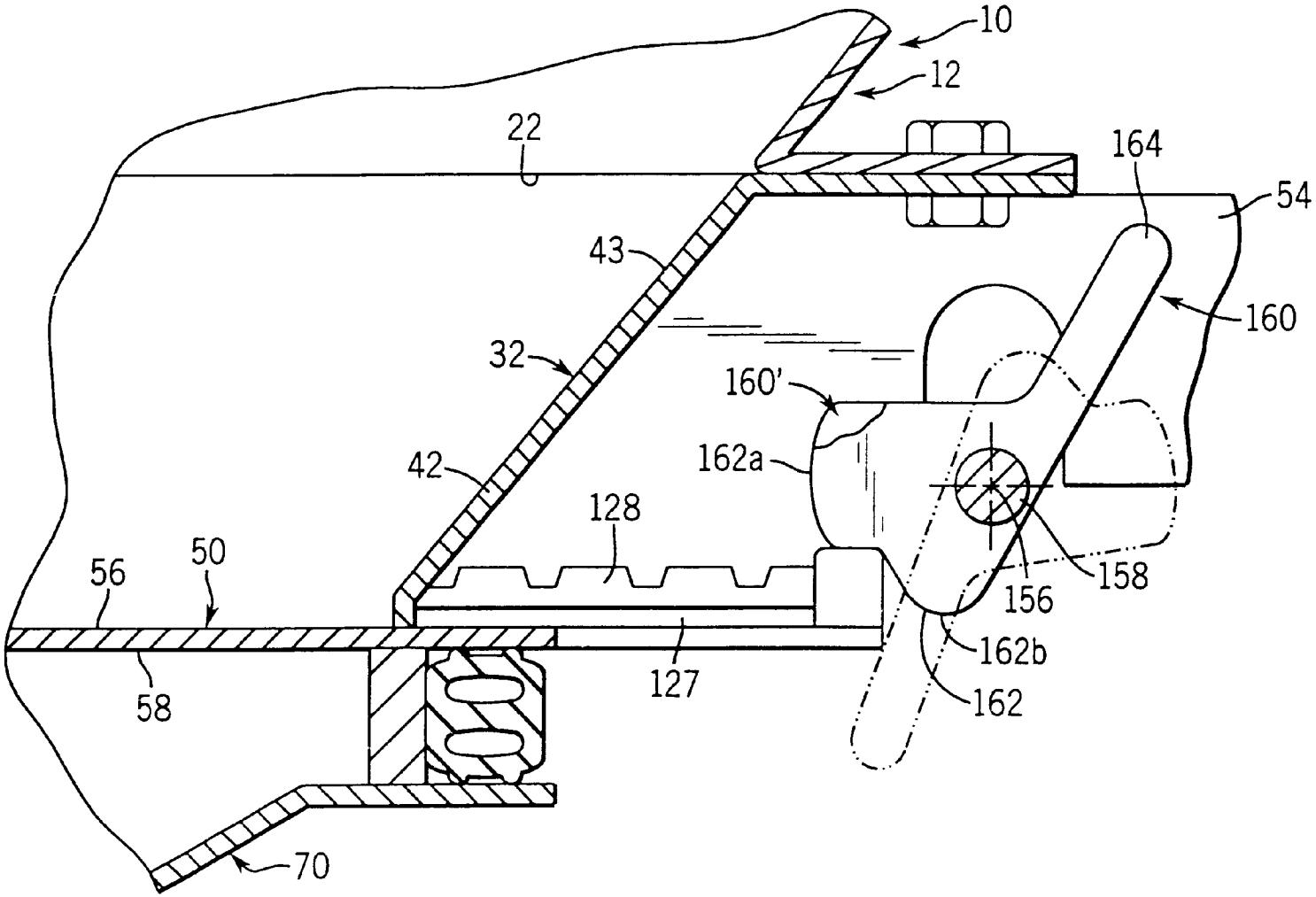
FIG. 11 is an enlarged sectional view taken along line 11—11 of FIG. 3.

The cam locking members 160, 160' are preferably configured alike. Accordingly, only cam locking member 160 will be described in detail. The cam locking members 160, 160' are both secured to the rockshaft 158 for movement in unison. As illustrated in FIG. 11, each cam locking member 160, 160' has a peripheral surface 162 having cam portions 162*a* and 162*b* arranged at different radial distances from the axis 156 about which each cam locking members 160, 160' turn in response to actuation as through rotation of either operating handle 152, 154.

When the gate or first element 50 is in the closed position, a portion of the gate or element 50 bears against the cam portion 162*b* of the cam face 162, thus, preventing the gate 50 from significantly moving in the opening direction (i.e., toward the right in the drawing). That is, and when the gate or first element 50 is in the closed condition, at least a portion of each cam locking member 160, 160' of locking mechanism 150 extends into the predetermined path of travel of the gate 50. Assuming a strong force would be applied to the slide gate 50 tending to move the gate 50 in the opening direction, the reaction of the cam locking member 160 to such force is advantageously almost in line with the axis 156 about which the element or member 160 rotates, thus, providing a structurally advantageous design.

It will be noted, cam portion 162*a* is substantially larger and, thus, substantially heavier than is the reminder of the lock member 160. As such, the cam portion 162*a* of the cam locking members 160, 160' tends to urge and maintain the lock mechanism 150 in a locked and self-engaging position or condition. As shown, each locking member 160, 160' furthermore preferably includes an arm 164 projecting radially away from the axis 156 about which each member 160, 160' turns. If so desired, the projecting arm 164 can be grasped to facilitate rotation and, thus, operation of the lock mechanism 150.

Advantageously, the single lock mechanism 150 is furthermore designed to inhibit inadvertent movement of the second element or pan assembly 70 toward the open position. In a preferred form, the operating handles 152, 154 of lock mechanism 150 are disposed at outer ends of the rockshaft 158. As such, the position of the operating handles 152, 154 and, thus, the condition of the lock mechanism 150 is readily apparent from an operator of the gate assembly 30.

Figure 12:
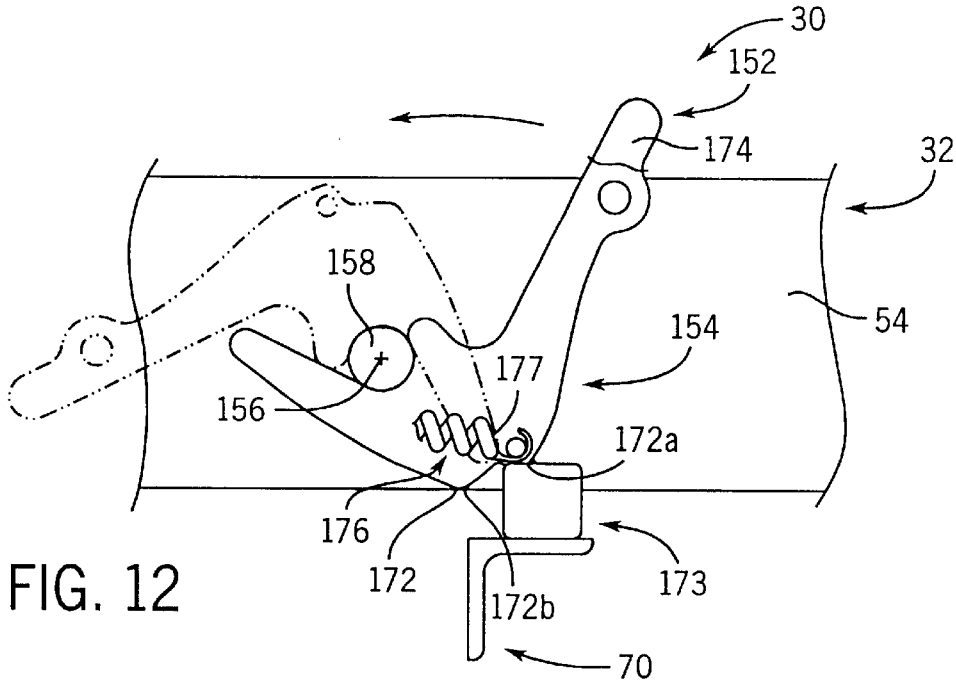
FIG. 12 is an enlarged side elevational view schematically illustrating a portion of a lock assembly arranged in combination with the gate assembly of the present invention.

The operating handles 152, 154 are preferably configured alike. Accordingly, only handle 154 will be described in detail. As illustrated in FIG. 12, each handle 152, 154 has a peripheral surface 172 having cam portions 172*a* and 172*b* arranged at different radial distances from the axis 156 about which each handle 152, 154 turns in response to manual movement of the ether handle 152, 154.

When the pan assembly or second element 70 is in the closed position, at least a portion of the pan assembly or element 70 bears against the cam portion 172*b* of the cam face 172 of each operating handle 152, 154 thus preventing the second element or pan assembly 70 from significantly moving in the open direction (i.e. toward the left in the drawing). That is, and when the pan assembly or second element 70 is in the closed condition, at least a portion of each operating handle 152, 154 of locking mechanism 150 extends into at least a portion of the predetermined path of travel of the pan assembly or second element 70.

In the illustrated embodiment, and as shown in FIG. 8, the second element or pan assembly 70 includes a pair of laterally aligned extensions 173 which project outwardly from opposite sides of the second element 70 for operable engagement with the handles 152, 154 in the manner discussed above. As illustrated in FIG. 12, and assuming a strong force would be applied to the pan assembly 70 tending to move the second element 70 in the opening direction, the reaction of the operating handles 152, 154 to such force is advantageously almost in line with the axis 156 about which each handle 152, 154 rotates, thus, providing a structurally advantageous design.

As shown in FIG. 12, each handle 152, 154 of lock mechanism 150 further includes an arm 174 projecting upwardly and radially away from the axis 156 about which each handle 152, 154 turns. The projecting arm 174 readily allows manual grasping by an operator to selectively condition the lock mechanism 150, from either side of the gate assembly 30, to allow for purposeful opening movements to be imparted to either the first element 50 or the second element 70 of the gate assembly 30.

Lock mechanism 150 is preferably designed such that it self-engages with the second element or pan assembly 70. As illustrated in FIG. 12, a mechanism 176 is preferably arranged in operative combination with the lock mechanism 150 for normally urging the lock mechanism 150 into a self-engaging or locked condition. In the illustrated form, mechanism 176 includes one or more springs 177 arranged in operable engagement with the operating handles 152, 154 of the lock mechanism 150. In a preferred form, one end of the spring 177 is connected to one side of and preferably below the rotational axis 156 about which the handles 152, 154 turn or rotate. The opposite end of the spring 177 is connected to a respective frame extension 52, 54 of frame 32 on an opposite side of the axis 156.

When more than one spring 177 is used to urge the operating handles 152, 154 of lock mechanism 150 into a self-engaging position or condition, the arrangement of each spring 177 relative to the operating handles 152, 154 is preferably identical. Accordingly, only the arrangement of one spring 177 with operating handle 152 will be discussed in detail. As illustrated in FIG. 12, each spring 177 urges the operating handles 152, 154 in a direction such that the cam portion 172*a* on each handle 152, 154 normally engages the respective extension 173 of the pan assembly 70. Thus, the lock mechanism 150 is normally urged into a locked and self-engaging condition relative to the pan assembly 70. Of course, the action of spring 177 furthermore serve to resiliently bias the cam locking members 160, 160' (FIG. 3) into locked engagement with the gate 50. As such, the lock mechanism 150 is normally urged into a self-engaging and locked condition relative to the gate 50. Of course, the operating handles 152, 154 can be readily displaced against the action of the spring 177. Moreover, other designs for mechanism 176 would equally suffice in addition to or in lieu of spring 177. For example, suitably counterbalancing the rockshaft 158 would likewise suffice to normally urge the lock mechanism 150 into a locked condition relative to the gate 50 and the pan assembly or second element 70 of the gate assembly 30.

Returning to FIG. 3, and as known in the art, each end of the operating shaft assembly 130 of drive mechanism 100 is journaled for rotation within an axially elongated hub 133 projecting outwardly and away from the frame extensions 52 and 54 of the rigid frame 32. In a most preferred form, the inner ends of the operating handles 134 of operating shaft assembly 130 are journaled for rotation within the axially elongated hubs 133.

Figure 13:
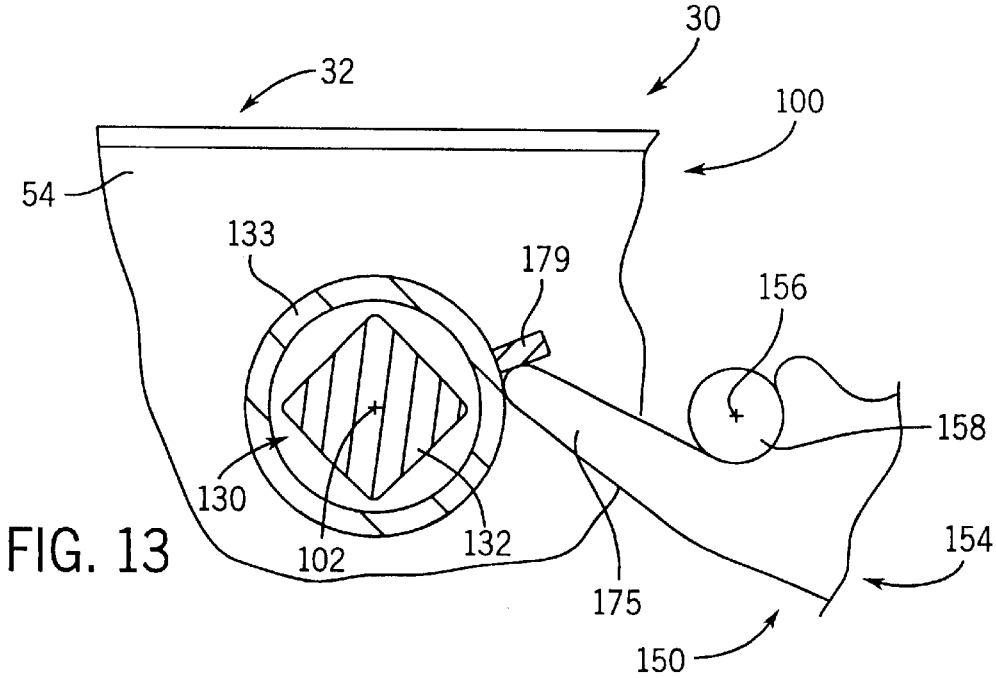
FIG. 13 is an enlarged fragmentary sectional view of a portion of the lock assembly.

As illustrated in FIG. 13, and in a preferred form, each operating handle 152, 154 of lock mechanism 150 is maintained in a proper self-engaging position or orientation after being released by the operator and notwithstanding the effect of mechanism 176 thereon. As shown, each operating handle 152, 154 preferably includes an additional arm 175 projecting away from the axis 156 and toward the fixed axis 102 of the second drive mechanism 100. As shown, the axially elongated hub 133 projecting outwardly from the frame extensions 52, 54 of frame 32 furthermore includes a radial projection 179 which is designed and disposed to engage a free end of the arm 175 of the respective operating handle 152, 154 thereby limiting the rotation of the operating handles 152, 154 about axis 156 and, thus, properly maintaining each operating handle 152, 154 of lock mechanism 150 in a proper self-engaging position or orientation after being released by the operator and notwithstanding the effects of mechanism 176 thereon.

Returning to FIG. 10, a preferred embodiment of gate assembly 30 is configured with a tamper seal arrangement for accepting a fracturable or breakable car seal 180 for providing a quick and visually identifiable indicator whether the gate or first element 50 has been moved toward and open position. In the embodiment illustrated in FIG. 10, the tamper seal arrangement involves providing each capstan or operating handle 114 of operating shaft assembly 110 with an enlarged radial portion 116 defining a throughbore or aperture 118 having a closed margin. Although only one operating handle 152 of lock mechanism 150 is shown in FIG. 10, each operating handle 152, 154 of lock mechanism 150 defines an opening 182 extending therethrough and having a closed margin. More specifically, in the illustrated embodiment, each radially projecting arm 174 of each operating handle 152, 154 of lock mechanism 150 defines the hole or opening 182. This tamper seal design or arrangement permits the car seal 180 to be inserted through both openings 118 and 182 in a closed loop. Thus, the car seal 180 must be broken before the gate 50 may be opened and the presence of an unbroken car seal 180 visually indicates and signifies the contents of the hopper car 10 are intact.

Turning to FIG. 14, seal structure 184 is provided for inhibiting debris and insect infiltration between the frame 32 of the gate assembly 30 and the second element or pan assembly 70. As illustrated in FIG. 14, a portion of the seal structure 184 involves providing a seal 186 transversely across a lateral edge or portion of and movable with the second element or pan assembly 70 between the racks 146 and 148 carried on element or pan assembly 70. The seal 186 is arranged in sealing engagement with the flange-like configuration 47 at the lower end of wall 40 of frame 32 thereby sealing the gate assembly 30 across that end thereof In the illustrated form, seal 186 is supported for movement with the pan assembly 70 by a depending arm or bracket 188 provided on the second element 70. In the illustrated embodiment, arm 188 is provided at the free or terminal end of the flange 86 provided on the second element or pan assembly 70. A suitable fastener 189, such as a threaded bolt and nut, can be used to releasably secure the seal 186 to the arm or bracket 188.

Seal 186 is preferably formed as an elongated and hollow elastomeric member 187. Moreover, seal 186 advantageously allows for horizontal discontinuities of either the arm 188 on the pan assembly or second element 70 or the flange-like configuration 47 at the lower ends of the end walls 40 and 42 of frame 32. Moreover, seal 186 is advantageously configured to automatically re-energize through either open or close directions of movements of the component or element of the gate assembly 30 with which the seal 186 is operably associated. Preferably, seal 186 is configured and designed substantially similar to that disclosed in coassigned U.S. Pat. No. 6,263,803 issued Jul. 24, 2001; the applicable disclosure of which is incorporated herein by reference.

Figure 15:
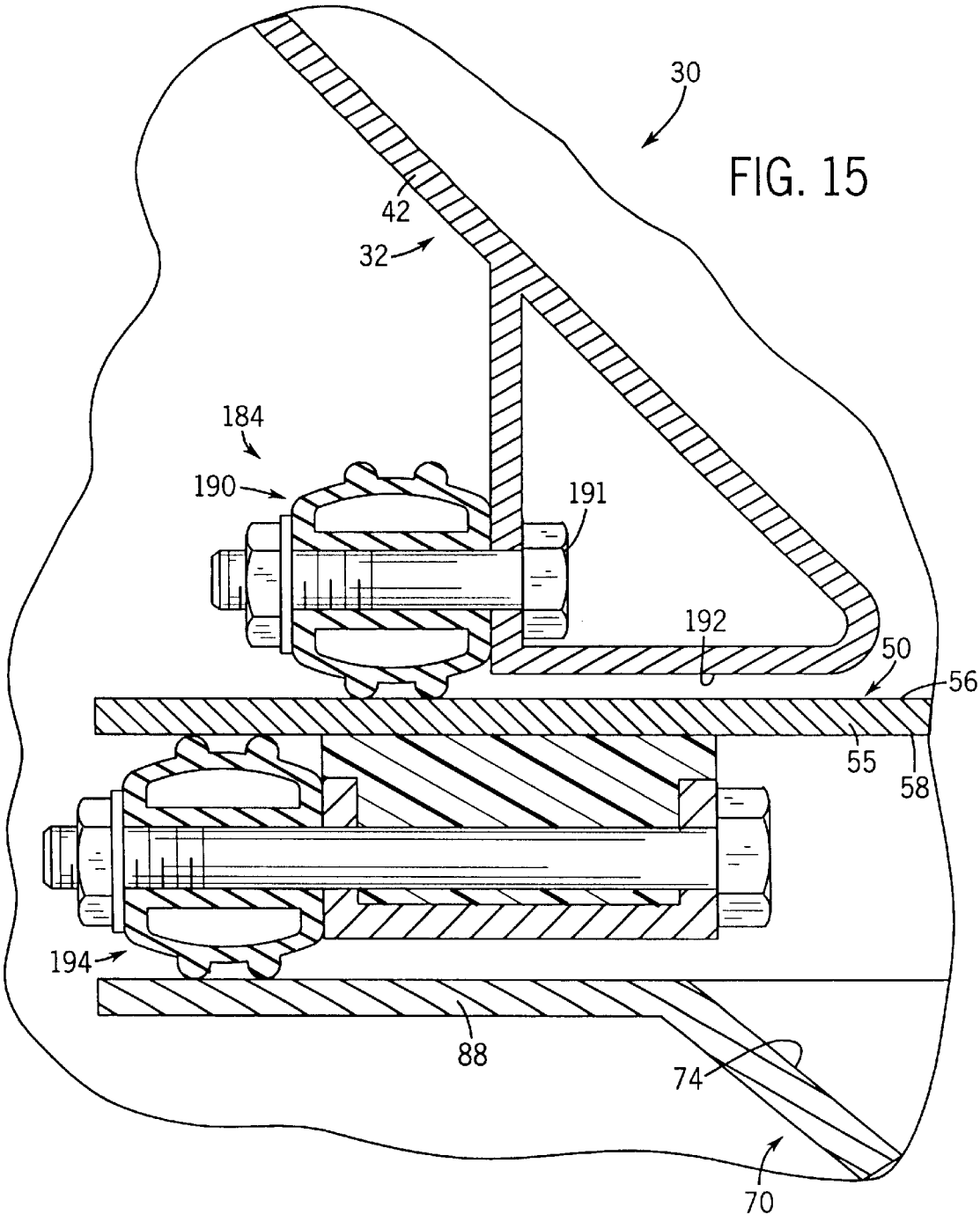
FIG. 15 is an enlarged sectional view taken along line 15—15 of FIG. 3.

In a preferred form, and as illustrated in FIG. 15, another portion of seal structure 184 is provided by a seal 190 extending transversely across the upper surface 56 of and toward an end of the gate 50 opposite from seal 186 (FIG. 14). Seal 190 is substantially identical to seal 186 discussed above. In a preferred embodiment, seal 190 is removably mounted to an exterior of and extends generally parallel to the end wall 42 of frame 32. Moreover, seal 190 extends across the upper surface of gate 50 and between the racks 126, 128 carried by the first element or gate 50. A series of spaced fasteners 191, such as bolts and nuts, serve to releasably secure the seal 190 to the frame 32 of the gate assembly 30. The primary purpose of the seal 190 is to inhibit contamination and insect infiltration between the frame 32 of gate assembly 30 and the upper surface 56 of gate 50 during transport and storage of hopper car 10.

As will be appreciated by those skilled in the art, and as illustrated in FIG. 15, the end wall 40 of frame 32 of gate assembly 30 is required to have an opening or elongated slot 192 extending transversely thereacross allowing for horizontal movements of the gate 50 between open and closed positions. Of course, the opening or slot 192 likewise provides a conduit or passage extending across and between the bottom or lower surface 58 of gate 50 and frame 32. Opening or slot 192 would normally permit dust, dirt, moisture and related debris to enter between the second element or pan assembly 70 and the lower side of the gate 50 and, thus, contaminate the lower side or surface 156 of the gate 50.

Accordingly, another portion of seal structure 184 is provided by a seal 194 extending transversely across the lower surface 58 of the gate 50 and the frame 32 in a manner sealing the opening 192 to prevent contamination of the lower surface 58 of the gate 50. Suffice it to say, seal 194 is substantially similar to seal 186. In a preferred form, seal 194 is releasably mounted to an exterior of and extends generally parallel to end wall 42 of frame 32. Moreover, seal 194 extends across the lower surface 58 of the gate 50 and between the racks 128, 128 carried by the first element or gate 50 (FIG. 7). Furthermore, seal 194 extends across the flange 88 of the second element or pan assembly 70 arranged in vertically spaced association with the gate 50 on the gate assembly 30. As such, seal 194 advantageously functions as a compression/wiper seal. Seal 194 is advantageously configured to permit its energization in either direction of movement or travel of the elements 50, 70 with which it is in sealing contact.

Figure 16:
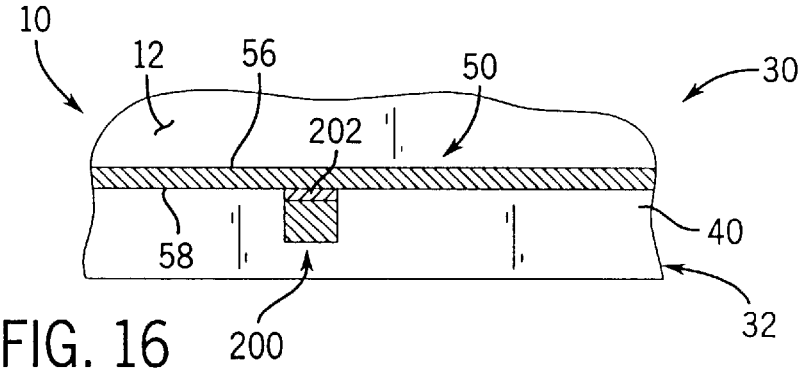
FIG. 16 is an enlarged sectional view taken along line 16—16 of FIG. 3.

Another preferred feature of gate assembly 30 relates to providing a support 200 beneath the gate 50 and, preferably, generally parallel to the direction of movement of the gate 50 as shown in FIG. 16. Support 200 is preferably configured as part of frame 32. The purpose of support 200 is to inhibit the gate 50 from deflecting beyond a predetermined limit under the influence of the materials in the enclosure 12 of hopper car 10 pressing downwardly thereon. As will be appreciated by those skilled in the art, limiting the deflection of gate 50 promotes sliding movement of the gate 50 through the opening or slot 192 provided in the frame 32 of the gate assembly 30 as the gate 50 moves between closed and open positions.

As will be appreciated, the material or lading within the hopper car 10 imparts a significant downward force on the gate 50. In a preferred form, and as further shown in FIG. 16, an ultra-high molecular weight polyethylene material 202 is disposed between an underside or bottom 58 of the gate 50 and the support 200 to reduce the coefficient of friction between the gate 50 and the support 200. That is, the purpose of the ultra-high molecular weight polyethylene material 202 is to promote sliding movement of the gate 50 relative to the support 200 notwithstanding the significant weight placed upon the gate 50 by the materials within the hopper car 10.

Returning to FIG. 3, the gate assembly 30 can further include a stationary hood structure or deflector 206 arranged between the upper surface 45 (FIG. 2) of the gate assembly 30 and the upper surface 56 of the gate 50. In a preferred form, the hood structure 206 extends directly over and extends in the same direction as the support 200. The hood structure or deflector 206 includes two angling sides 208 and 210 which are preferably joined along a common top edge 212 and angularly diverge away from each other as they extend downwardly toward the gate 50. As known in the art, the purpose of the hood structure or deflector 206 is to lessen the column load imparted to the gate 50 by the materials in the enclosure 12 of the hopper car 10. Of course, lessening the column load imparted to the gate 50 reduces the torque requirements which must be imparted to the drive mechanism 90 for moving the gate 50 from a closed position, whereat the gate 50 extends across the discharge opening 34 defined by the frame 32 of the gate assembly 30, and an open position.

Figure 17:
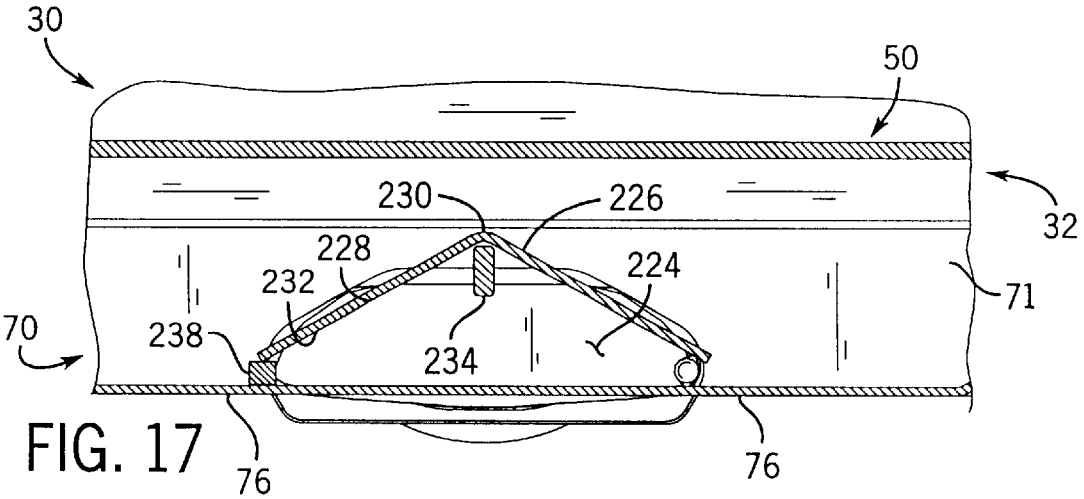
FIG. 17 is a side sectional view taken along line 17—17 of FIG. 8.
Figure 18:
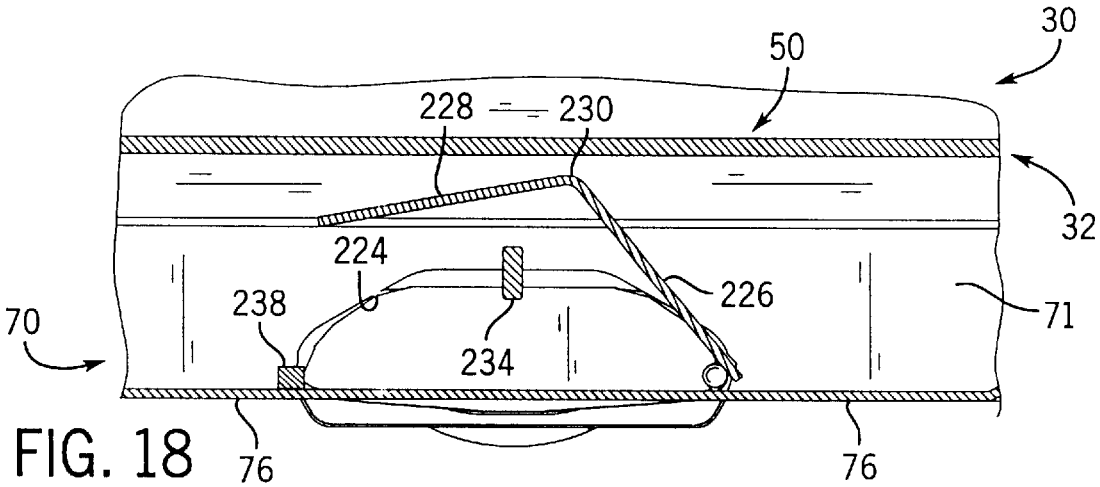
FIG. 18 is a side sectional view similar to FIG. 17 but illustrating a cover in a non-operational position.

As illustrated in FIGS. 8, 17 and 18, the open top pan assembly 70 further includes a movable inverted V-shaped deflector or hood 220 arranged in operable combination therewith. As known in the art, each side wall 71, 72 of the pan assembly 70 defines a pair of laterally aligned through-openings or ports 224 extending therethrough (with only one throughopening or port being shown in side wall 71 in FIGS. 17 and 18). In the illustrated embodiment, the deflector or hood 220 extends laterally across the pan assembly 70 between the ports 224. As shown, the deflector or hood 220 is provided with downwardly angling slope sheets 226 and 228 which are joined across an upper portion 230 and which angularly diverge relative to each other such that the deflector or hood 220 defines a tunnel-like passage 232 on the underside of the slope sheets 226, 228. Preferably, a rigid and stationary support 234 (FIGS. 17 and 18) extends between the side walls 71, 72 of the pan assembly 70. The support 234 cooperates with the underside of and supports the deflector or hood 220 along the length thereof.

In the preferred form, the deflector or hood 220 is hingedly or rotatably connected to the bottom 76 of the pan assembly 70 thereby allowing the deflector 220 to be moved from an operational position, illustrated in FIGS. 7 and 17, to a non-operational position, illustrated in FIG. 18. As shown, at least a lengthwise portion of the free or terminal edge of slope sheet 226 is hingedly joined to the pan assembly 70 in a manner permitting for rotation and vertical movement of the deflector or hood 220 about a generally horizontal axis. In the illustrated embodiment, the free or terminal edge of slope sheet 228 is supported above the bottom 76 of the pan assembly 70 thereby defining an elongated lengthwise opening 236 (FIG. 8) leading to the passage 232 of the deflector 220 and, ultimately, leading to the ports 224. In a preferred form, one or more spaced lugs 238 are provided along the bottom 76 of the pan assembly 70 for maintaining the free or terminal edge of the slope sheet 228 in elevated relation relative to the bottom 76 of the pan assembly 70. Tests have revealed the hood-like design of deflector 220 enhances the pneumatic discharge of materials from the enclosure 12 of the hopper car 10.

Returning to FIG. 8, a first transition tube or hopper discharge outlet 240 is connected to and extends laterally from the side wall 71 of the open top pan assembly 70. As will be appreciated by those skilled in the art, the innermost end of the first transition tube or outlet 240 is contiguous with and in material receiving relation relative to the port or opening 224 defined in the side wall 71 of the pan assembly 70. A second transition tube or hopper discharge outlet 242 is connected to and extends laterally from the side wall 72 of the open top pan assembly 70. As will be appreciated by those skilled in the art, the innermost end of the first transition tube 242 is contiguous with and in material receiving relation relative to the port or opening 224 defined in the side wall 72 of the pan assembly 70. In a preferred form, the transition tubes or outlets 240 and 242 are substantially identical relative to each other. Accordingly, only transition tube or outlet 240 will be discussed in detail.

As known in the art, an outer end of each discharge outlet 240, 242 is shaped to conform with a standardized coupling or connector of pneumatic lading withdrawal equipment (not shown). The exemplary embodiment contemplates configuring the free end of each outlet 240, 242 with a tubular and cylindrical cross-section. During pneumatic withdrawal of the lading from the enclosure 12 of the hopper car 10 (FIG. 1), the pneumatic lading withdrawal equipment provides a vacuum which functions to draw the lading or material into the tunnel-like passage 232 (FIG. 17) defined by the hood or deflector 220, through one of the ports 224, and thence through the associated one of the transition tubes 240, 242, and then through the pneumatic lading withdrawal equipment itself, which then deposits the lading or materials removed from the enclosure 12 of the hopper car 10 in a remote hopper or other storage facility.

Suffice it to say, and as illustrated in FIGS. 8 and 19 through 21, each tubular outlet 240, 242 defines a generally vertical abutment surface 246 disposed inwardly from a free or terminal end of each tubular outlet 240, 242. Suffice it to say, the generally vertical abutment surface 246 projects radially outwardly from and about the circular and tubular cross-sectional configuration of the respective tube 240, 242. In a preferred form, surface 246 is provided by a vertical flange 247 disposed along the length of each tubular outlet 240, 242 inwardly from a free end thereof Suitably shaped gussets 248, disposed on opposed sides of and extending between an inner side of each flange 247 and the respective horizontal side of the respective transition tube 240, 242, add strength and rigidity to the flange-like structure 247.

Each transition tube or hopper discharge outlet 240, 242 has an assembly or sealing arrangement, generally indicated by reference numeral 250 in FIGS. 7 and 18 through 25, for selectively closing the free or discharge end of each tubular outlet 240, 242. That is, and depending upon the relation of assembly 250 relative to the free end of the respective tubular outlet 240, 242, the pan assembly 70 of gate assembly 30 is conditioned for either pneumatic discharge of lading or material from the enclosure 12 of hopper car 10 (FIG. 1) or for transport between locations.

Each closure assembly 250 includes an end cap or cover 252. In a closed position, schematically represented in FIGS. 19 and 25, the end cap or cover 252 fits about and partially along to cover a free end of the pneumatic discharge outlet 240, 242. The cap or over 252 is sealed against the abutment surface 246 on each outlet tube 240, 242. The seal is maintained by a gasket 254 forming part of the closure assembly 250. As will be appreciated, gasket 254 is interposed between the cover 252 and the abutment surface 246 on the outlet tube 240, 242 when the cap 252 is in the closed position thereby inhibiting contaminants from passing between the cover 252 and the respective transition tube and into the open top pan assembly 70.

In the illustrated embodiment, the free end of the respective transition tube 240, 242 has a hollow cylindrical cross-sectional configuration. Accordingly, the end cap or cover 250 likewise has a cylindrical cross-sectional configuration and the abutment surface 246 has a generally annular configuration extending radially outwardly from a respective outlet tube 240, 242. Of course, if the free end of the transition tube 240, 242 were otherwise configured, i.e. in a semi-circular design for example, the cross-sectional configuration of the end cap or cover 150 and the abutment surface 246 would likewise be modified to close and seal the free end of the respective transition tube 240, 242.

Another unique aspect of the present invention involves the ability of an operator to use only one hand to move the cap or cover 252 between a first or closed position and a second or open position while retaining the end cap or cover 252 in operative association with the respective transition tube 240, 242. The closed position for the end cap or cover 252 is illustrated in solid lines in FIGS. 19 through 21. The second or open position for the end cover 252 is illustrated in FIG. 8.

The cover 252 of each closure assembly 250 is movably connected at one side to the flange-like structure 247 to allow for both sliding and rotational movement of the cap or cover 252 relative to the free or terminal end of the outlet tube 240, 242. As illustrated in FIGS. 19 through 22, structure 256 operably interconnects the cap or cover 252 to one side of the respective flange 247 on each outlet tube 240, 242. Structure 256 serves multiple purposes. First, structure 256 serves to maintain a respective cap 252 in operable engagement with the respective outlet tube 240, 242. Second, structure 256 is configured to permit both pivotal and lengthwise movements of the cap 252 relative to the abutment surface 256 thereby facilitating one-handed operation of each closure assembly 250, if desired. Moreover, structure 256 serves to cam the closure cap or cover 252 into the closed position thereby promoting the tightness of the seal formed between the cap 252, the gasket 254 and the abutment surface 246 while furthermore promoting release of the closure cap 252 from the closed position with the outlet tube 240, 242 to allow for pneumatic discharge of material or lading while reducing the risk of potential damage to the gasket 254 thereby promoting the life of the gasket 254.

In the illustrated form, structure 256 includes vertically spaced cap mounting flanges 257, 258 projecting to one side of the cap 252. The flanges 257, 258 generally correspond in configuration and define a catch or cam 260 at the outer terminal free end thereof. As illustrated, and as they extend away from the cap 252, the flanges 257, 258 are generally planar in configuration and, in the illustrated form, are horizontally disposed to opposite vertical and generally parallel surfaces 261, 263 of and embrace a cap mounting bracket 262 extending, in the illustrated embodiment, away from the flange-like structure 247 on each outlet or transition tube 240, 242.

Figure 23:
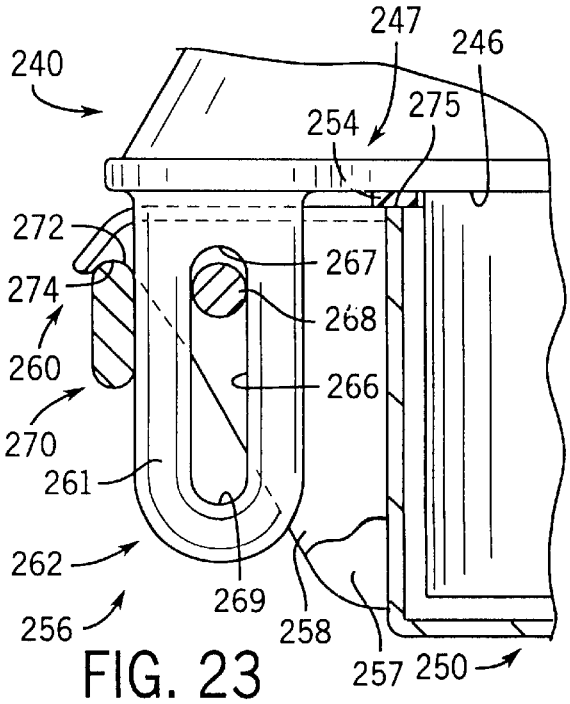
FIG. 23 is a partial sectional view taken along line 23—23 of FIG. 22.

As shown in FIG. 23, the cap mounting bracket 262 defines an elongated slot 266. Structure 256 further includes a vertically elongated pin or fastener 268 which passes endwise through the cap mounting flanges 257, 258 and through the slot 266 in the cap mounting bracket 262 thereby controlling and limiting movements of the end cap or cover 252 as the cover 252 moves between the open and closed positions. As will be appreciated, opposite ends of the elongated slot 266 define stops 267 and 269 (FIG. 23) which serve to limit movements of the end cap or cover 252 toward and away from the abutment surface 246 on the outlet tube 240, 242.

Figure 21:
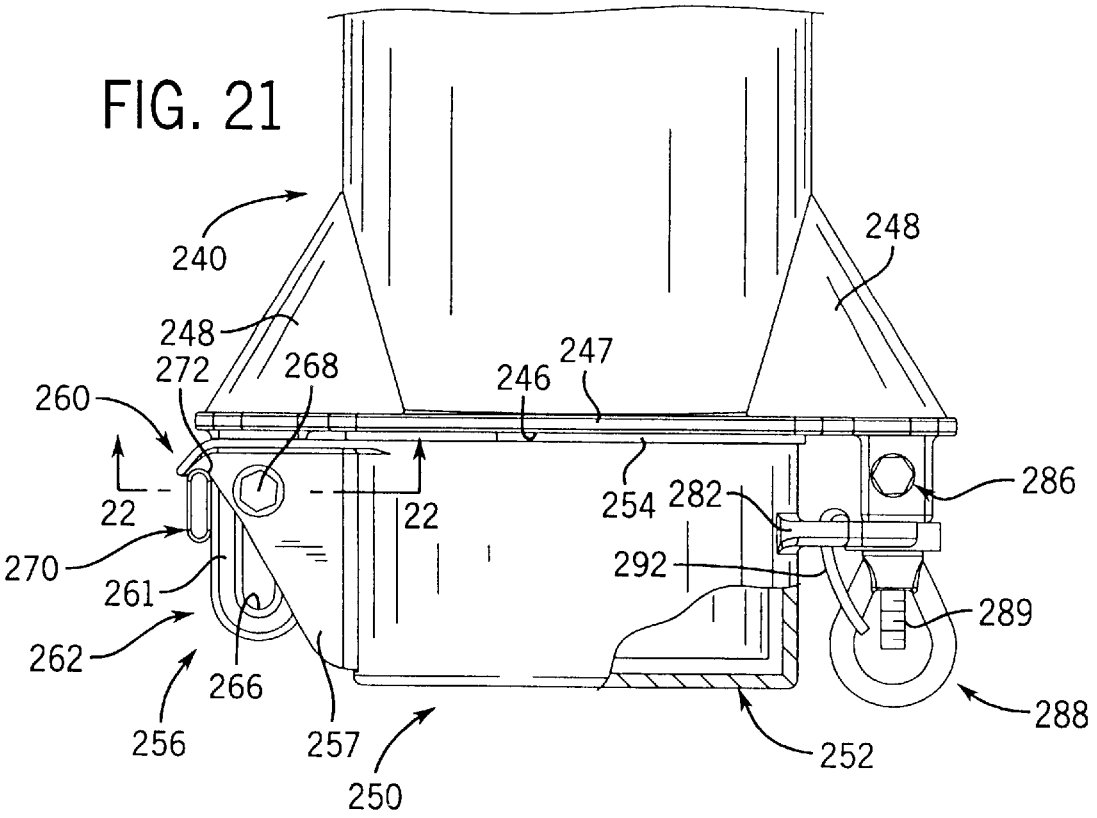
FIG. 21 is a top plan view of the closure assembly illustrated in FIG. 20 in a closed position, with parts broken away to show details.
Figure 22:
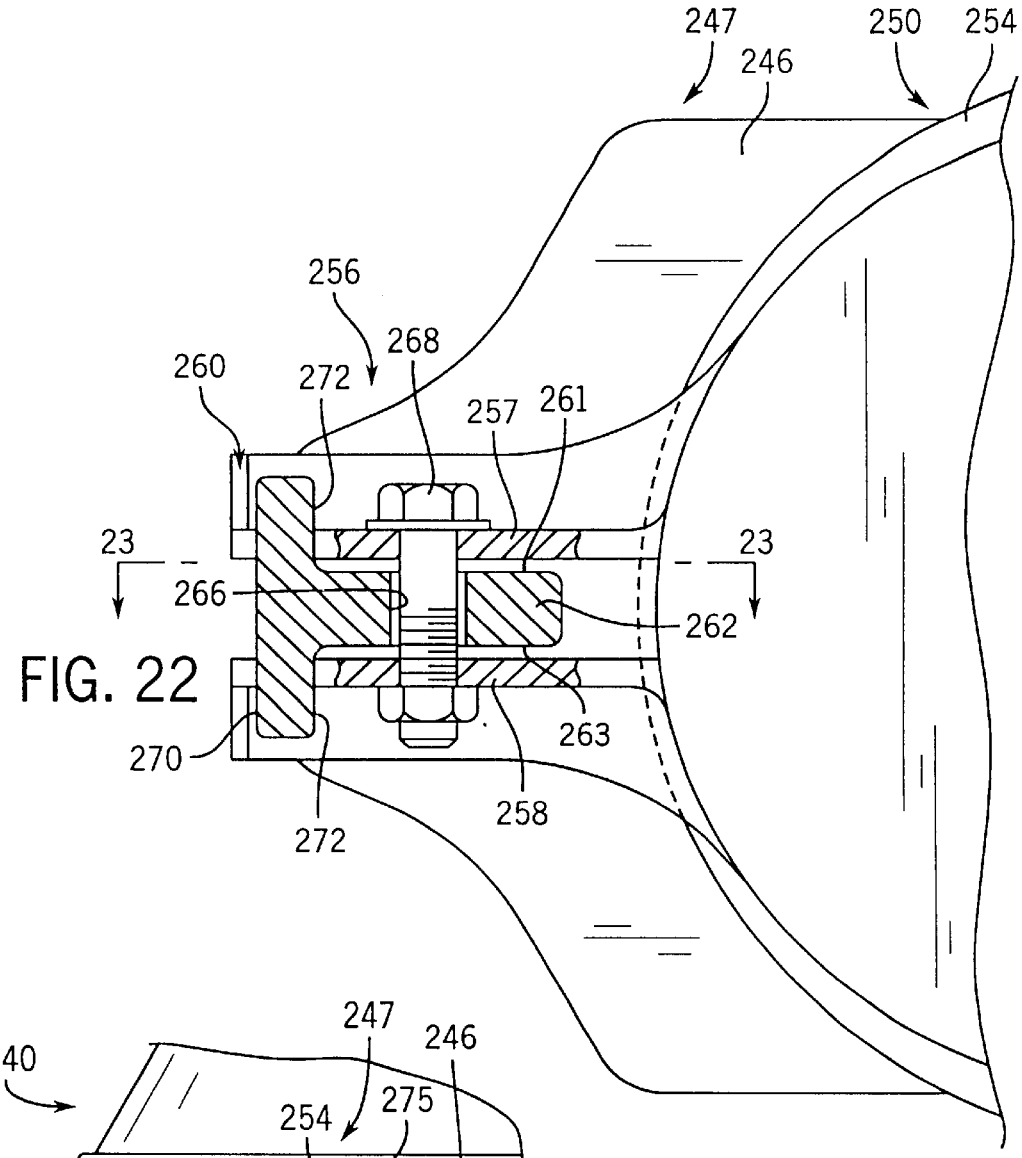
FIG. 22 is a partial sectional view taken along line 22—22 of FIG. 21.

Structure 256 further includes a generally upright cam lock pivot pin 270 disposed in predetermined relation relative to the abutment surface 246 on each outlet or transition tube 240, 242. In the illustrated form, the cam lock pivot pin 270 is connected to and extends generally normal to the cap mounting bracket 262. As shown in FIG. 21, the cam lock pivot pin 270 extends vertically past the upper and lower surfaces 261, 263 of the cap mounting bracket 262. At least that portion of the cam lock pivot pin 270 extending vertically past the upper and lower surfaces 261 and 263, respectively, of the cap mounting bracket 262 is provided with a camming surface 272 disposed a predetermined distance from the abutment surface 246 on each outlet tube 240, 242.

As illustrated in FIGS. 23, the catch or cam 260 defined by the flanges 257, 258 cooperate with the camming surface 272 on the cam lock pivot pin 270 as the cap or cover 252 approaches the closed position to effect sealing of the cap or cover 252 to the respective outlet tube 240, 242. As will be appreciated, the cam 260 on each flange 257, 258 defines a cam surface 274 which is complimentary to cam surface 272 on the cam lock pivot pin 270 and is disposed a predetermined distance from an innermost edge 275 (FIG. 23) of the respective end cap or cover 252. As illustrated, the catch or cam 260 on each cap 252 is specifically configured to permit the catch 260 to wrap partially around and about the cam surface 272 on the cam lock pivot pin 270 as the cap 252 is moved toward the closed position and, yet, permits the catch 260 to readily disengage from the cam surface 272 on the cam lock pivot pin 270 as the cap 252 is moved toward the open position. As will be appreciated, the camming surface 274 on the catch 260 acts in operative combination with the camming surface 272 on the cam lock pivot pin 270 to properly position the inner most edge 275 of the cap 252 relative to the abutment surface 246 as the cap 252 moves toward a closed condition or position thereby compressing or driving the gasket 254 with a predetermined and measured force sufficient to establish a predetermined compressive force to seal the closure cap 252 and the outlet or transition tube 240, 242.

Arranged in generally diametrically opposed relation from but for operable combination with structure 256 is a retainer apparatus 280 for releasably securing the cap 252 in a closed or transport position. As illustrated in FIGS. 19 through 21 and 24, retainer apparatus 280 includes a flange 282 extending from cap 252 in a direction opposed to flanges 257, 258 and defining an open ended slot or groove 284 (FIG. 25) which opens to the side of the cap 252. When the cap or cover 252 is in a closed position, the flange 282 thereon extends generally parallel with the flange-like structure 247 on each transition tube 240, 242.

Figure 24:
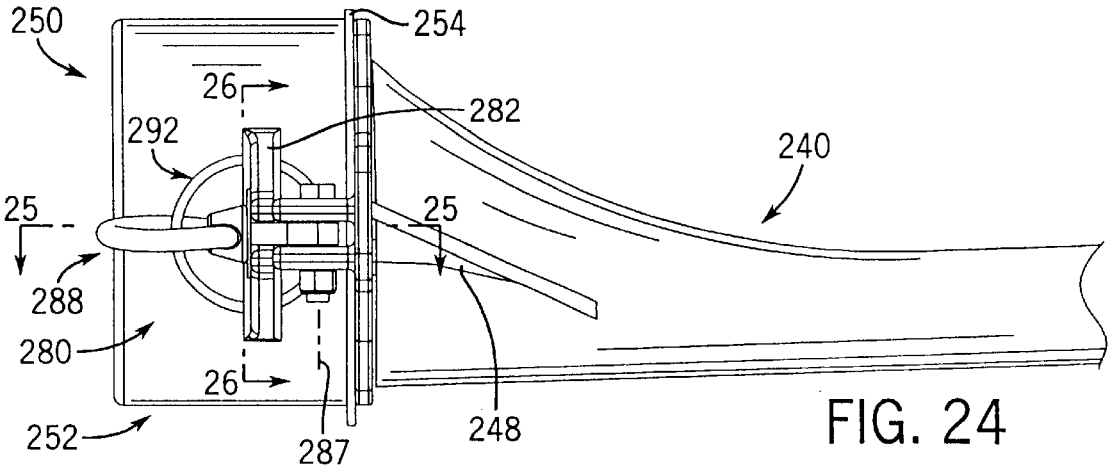
FIG. 24 is an end view of the closure assembly.
Figure 25:
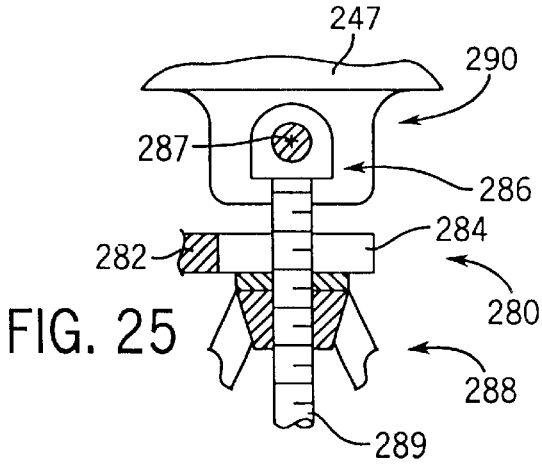
FIG. 25 is a sectional view taken along line 25—25 of FIG. 24.
Figure 26:
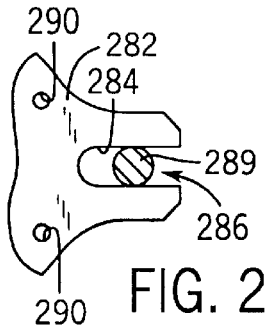
FIG. 26 is a sectional view of taken along line 26—26 of FIG. 24.

In the exemplary embodiment illustrated in FIGS. 19 and 25, retainer apparatus 280 furthermore includes a two-piece swivel type retainer including a threaded fastener 286 and an eye bolt 288. The threaded fastener 286 is operably associated with the flange-like structure 247 and rotates about a fixed generally vertical axis 287. As shown, fastener 286 includes a free ended threaded shank 289. In the illustrated embodiment, the flange-like structure 247 on each transition tube 240, 242 of the pan assembly 70 includes a clevis-like structure 290 which projects outwardly away from the flange-like structure 247. One end of the threaded fastener 286 is embraced between the parallel arms of the clevis 290 and is permitted to turn about the axis 287. As will be appreciated by those skilled in the art, the fastener 286 is rotatably secured to the flange-like structure 247 on each transition tube 240, 242 such that the threaded shank 289 of the fastener 286 is permitted to align with and freely pass into the open end of the slot 284 on the flange 282 (FIGS. 23 and 24).

As will be appreciated, the eye bolt 288 combines with the threaded shank 289 and the flange 282 on the respective cap 252 to releasably maintain the end cap or cover 250 in the closed position. Of course, to open the end cap 252, an operator merely needs to rotate the eye bolt 288 until the fastener 286 of the retainer apparatus 280 is free to rotate about axis 287. Thereafter, the retainer apparatus 280 is conditioned to allow the end cap 252 to be moved from the closed position to the open position in a manner permitting one-handed operation to open or close the end cap 252 relative to a respective transition tube 240, 242. Of course, and even after the retainer apparatus 280 is released from operable association with the end cap 252, the retainer apparatus 280 remains operably associated with the flange-like structure 247 on each transition tube 240, 242 thereby inhibiting inadvertent loss of the retainer apparatus 280.

In the embodiment illustrated in FIGS. 19 and 20, the flange 282 on each end cap 250 is provided with one or more openings 290 extending therethrough and which are arranged in proximate relation to the eyebolt 288. As illustrated in FIGS. 19 and 20, the apertures or openings 290, in combination with the eyebolt 288, permit insertion of a security seal 292. As will be readily appreciated, the security seal 292 provides a visual indicator on whether the end cap 252 has been tampered with at any time prior to pneumatic discharge of material through the related outlet tube 240, 242 of the pan assembly 70.

One advantage offered by the gate assembly 30 of the present invention relates to the unique ability to unload lading or material from the enclosure 12 of the hopper car 10 (FIG. 1) as by gravity or pneumatically whichever best suits the needs of the end user. Moreover, and because the gate assembly 30 of the present invention is preferably manufactured or fabricated from FDA approved materials, the gate assembly 30 of the present invention readily lends itself to transport of food stuff or food grade material.

During transport of the hopper car 10 between locations, the lock mechanism 150 maintains the gate 50 of gate assembly in the closed condition thereby inhibiting inadvertent loss of materials or lading from the hopper car 10. One of the salient features involving lock assembly 150 relates to the ability of the single lock mechanism 150 to not only maintain the gate 50 of the gate assembly 30 in the closed position, but at the same time, the lock mechanism 150 serves to maintain element or pan assembly 70 in the closed position. As will be appreciated from an understanding of the invention, the unique ability of the lock mechanism 150 to serve this dual function is facilitated by arranging the operating shaft assemblies 110 and 130 of drive mechanisms 90 and 100, respectively, in horizontally adjacent relation relative to each other. More specifically, the horizontally adjacent arrangement of the operating shaft assemblies 110 and 130 allows the lock mechanism 150 to be disposed therebetween, thus, allowing one mechanism 150 to service both drives 90 and 100.

Of course, arranging the operating shaft assemblies 110 and 130 in horizontally adjacent relation relative to each other furthermore reduces the height profile or effective height between the upper surface 45 and lower surface 75 of the gate assembly 30 and, thereby provides enhanced ground clearance for the gate assembly 30 relative to the roadbed. Moreover, having each operating shaft assembly 110 and 130 rotate about axes 92 and 102, respectively, which are spatially fixed relative to the frame 32 readily lends the gate assembly 30 of the present invention to use with powered drivers to open and close the first and second elements 50 and 70 of the gate assembly 30 relative to the discharge opening 34. Having each operating shaft assembly 110, 130 of the gate assembly 30 rotate about an axis which is fixed relative to the frame 32 furthermore advantageously allows the force inputted to the operating shaft assembly 110, 130 to be transferred to the frame 14 of the railroad car 10 as long as the axes 92,102 are disposed proximate to the end wall 42 of the gate frame 32. Furthermore, providing the two separately operated shaft assemblies 110 and 130 for rotation about first and second axes 92 and 102, respectively, which are each fixed relative to the frame 32 advantageously permits independent operation of the two elements 50 and 70 while concurrently permitting an operator to validate the cleanliness of commodity contacting surface areas on the elements 50, 70 as the elements 50, 70 move between positions.

Assuming the gate 50 of the gate assembly 30 is to be opened to permit the car's contents to be discharged gravitationally, one of the first steps would be to remove the security or tamper seal 180 maintaining the operating handles 152, 154 of the lock mechanism 150 in a locked condition or position. Of course, removal of the seal 180 permits the lock mechanism 150 to be released or conditioned in an unlocked position thereby unlocking the open top pan assembly 70. In the illustrated embodiment, the lock mechanism 150 is released by rotating either operating handle 152, 154 in the direction of the arrow illustrated in FIG. 12 from the solid line position to the dash line position. With the illustrated embodiment, this is easily effected by grasping the projection or arm 174 and rotating either handle 152, 154 about the fixed rotational axis 156. As may be appreciated, arranging the operating handles 152, 154 laterally outside of the frame 34 of the gate assembly 30 facilitates both physical and visual access to the lock assembly 150.

As illustrated schematically in FIG. 12, rotation of the operating handles 152, 154 of lock mechanism 150 removes the peripheral surface 172 from the predetermined path of travel of or contract with that portion 173 of the pan assembly 70 operable in conjunction with the lock assembly 150 for maintaining the second element or pan assembly 70 in the closed position. In the illustrated embodiment, and as the operating handles 152, 154 are moved to the unlocked position (shown in dash lines in FIG. 12), the location whereat the spring 177 attaches to the operating handles 152, 154 moves from one side of the rotational axis 156 over center and to an opposite side of the rotational axis 156. Accordingly, and after the handles are moved to the dash line position illustrated in FIG. 12, spring 177 serves to releasably hold the operating handles 152, 154 in the unlocked condition.

With the lock mechanism 150 in an unlocked or released position, the pan assembly 70 can be moved to an open position and from beneath the gate 50 of the gate assembly. Movement of the pan assembly 70 is effected as through operation of drive mechanism 100. In the illustrated embodiment, the operating shaft assembly 130 of drive mechanism 100 is rotated about the fixed axis 102. Rotation of the drive mechanism 100 is converted to linear fore-and-aft movement of the second element or pan assembly 70 of the gate assembly 30 as through the rack and pinion assembly 140. More specifically, rotation of the operating shaft assembly 130 causes the racks 146 and the second element or pan assembly 70 to move concomitantly relative to the frame 32 of the gate assembly 30. Notably, the racks 146 of the rack and pinion assembly 140 are disposed laterally outwardly from the discharge opening 34 of the frame 32 of the gate assembly 30 so as to not interfere with the sealing engagement of seal structure 184 along the underside or bottom 58 of the gate 50.

Besides having the operating shafts 110 and 130 of drive mechanisms 90 and 100, respectively, arranged in horizontally adjacent relation relative to each other, in a preferred form of the invention, the operating shafts 110 and 130 each turn in the same direction to effect opening and closing movements of the respective elements 50 and 70. As will be appreciated by those skilled in the art, the ability to operate the operating shafts 110 and 130 in the same direction relative to each other so as to move the elements 50 and 70 in a particular direction simplifies operation of the gate assembly 30 while eliminating costly human errors.

Returning to FIG. 12, movement of the open top pan assembly or second element 70 of the gate assembly 30 carries therewith the aligned extensions 173 arranged to cooperate with the lock mechanism 150. The second element or pan assembly 70 of the gate assembly 30 is moved in a linear direction relative to the frame 34 a sufficient amount or until stops 147 limit continued movement of the second element or pan assembly 70 toward the open position.

In the preferred form, the lock assembly 150 is configured to automatically return to a locked condition in timed relation relative to movement of the second element or pan assembly 70 toward an open position or condition. With the lock assembly 150 being automatically returned to a locked condition following a predetermined amount of movement of the second element or pan assembly 70 toward an open position, the cam locking members 160 and 160' (FIG. 11) carried on the rockshaft 156 are automatically returned to a position whereby they inhibit inadvertent movement of the gate 50 toward an open position.

In the illustrated embodiment, and after the operating handles 152, 154 of lock mechanism 150 are moved to an unlocked position (shown in dash lines in FIG. 12), the arm 175 of each operating handle 152, 154 of lock mechanism 150 is positioned in the path of movement of that portion (extensions 173) of the second element or pan assembly 70 normally engaged by the lock mechanism 150 when the second element or pan assembly 70 is in the closed condition or position. Accordingly, and as the second element or pan assembly 70 moves toward an open position, each extension 173 of element 70 engages and rotates the arm 175 of each operating handle 152, 154 against the action of spring 177 in a direction whereby automatically returning the operating handles 152, 154 of lock mechanism 150 to a locked condition. Of course, as the operating handles 152, 154 move toward their locked position, the spring 177 again is moved overcenter and, thus, promotes movement of the operating handles 152, 154 to their locked condition. The operating handles continue their movement toward the locked condition or position until the arm 175 of each operating handle 152, 154 engages the radial extension or projection 179 (FIG. 13) on the hub 133 thereby limiting further rotational movement of the operating handles 152, 154 about axis 156.

With the second element or pan assembly 70 in an open position, it is now possible to open the gate 50 thereby conditioning the gate assembly 30 for gravitational discharge of the lading from the enclosure 12 of hopper car 10. As mentioned above, in a preferred embodiment, lock mechanism 150 is automatically returned to a locked condition after element 70 is moved to an open position thereby inhibiting inadvertent movement of the gate 50 toward an open position. Accordingly, before gate 50 can be moved toward an open position, the lock mechanism 150 must be again purposefully released from its closed or locked position as through rotation of the handles 152, 154 in the direction of the arrow illustrated in FIG. 12. As mentioned, release of the lock mechanism 150 can be effected as through grasping and rotating the projection or arm 174 on the operating handles 152, 154 or by grasping the arm or projection 164 on the cam locking members 160, 160'. As will be appreciated from an understanding of this embodiment, rotation of the operating handles 152, 154 causes the rockshaft 156 to rotate, thus, rotating the cam locking members 160, 160' from the solid line position illustrated in FIG. 11 to the dash line position illustrated in FIG. 11. In the released or dash line position illustrated in FIG. 11, the peripheral surface 162*b* of the cam locking members 160, 160' is removed from the path of travel of the gate 50 and, thus, element or gate 50 is free to move toward an open position.

Movement of element or gate 50 is effected as through operation of drive mechanism 90. In the illustrated embodiment, the operating shaft assembly 110 of drive mechanism 90 is rotated about the fixed axis 92. Rotation of the drive mechanism 90 is converted to linear fore-and-aft movement of element or gate 50 of the gate assembly 30 as through the rack and pinion assembly 120. More specifically, rotation of the operating shaft assembly 110 forcibly causes the racks 126 and element or gate 50 to move concomitantly relative to the frame 32 of the gate assembly 30 toward an open position. The element or gate 50 is opened to an extent allowing lading to gravitationally fall from the hopper car 10 at a controlled rate or the gate 50 is opened until the stops 125 operably associated with rack and pinion assembly 120 limit further movement of the gate 50 toward an open position. In an open position, the gate 50 is removed from across the discharge opening 34 of the frame 32 thereby permitting the gravitational discharge of material or lading from the enclosure of the hopper car 10. Notably, the racks 126 of the rack and pinion assembly 120 are disposed laterally outwardly from the discharge opening 34 of the frame 32 of the gate assembly 30 so as to not interfere with the sealing engagement of the seal structure 184 along the underside or bottom 58 of the gate 50.

As mentioned above, the lading or material within the hopper car 10 imparts a significant downward load or force on the gate 50 of the gate assembly 30. In an effort to enhance the openability of the gate 50 from the closed position, and in an effort to reduce the torque required to open the gate 50, the hood structure or deflector 206 is provided across and over the discharge opening 34 defined by the gate assembly 30. As will be appreciated, the downward force on the gate 50 is, at times, significant enough to cause the gate 50 to bow or bend. Of course, forcibly moving a bent or bowed gate through the opening or slot 192 in the frame 34 FIG. 15) of the gate assembly can add to the difficulty and problems in fully opening the gate 50 not to mention the added torque requirements needed to fit the bowed gate through the slot or opening 192 in the frame 34 of the gate assembly 30. Testing has revealed the deflector 206 assists in distributing the column load placed upon the gate 50 by the lading within the enclosure 12 of the hopper car 10.

In a preferred form, the frame 34 of the gate 30 is provided with the support 200 extending thereacross. As will be appreciated from an understanding of this disclosure, the support 200 limits the vertical displacement of the gate 50 relative to the frame 34. The addition of the ultra-high molecular weight material 202 between the undersurface or bottom 58 of the gate 50 and the support 200 furthermore enhances the ability to move the gate 50 toward an open position notwithstanding the significant weight added thereto from the lading in the hopper car 10.

Furthermore, the preferred design of gate assembly 30 contemplates elevating the racks 126,128 of rack and pinion assembly 120 used to move the gate 50 to lessen the coefficient of friction between the rack and pinion assembly 120 and the frame 34 as the gate 50 moves toward an open position. Again, the addition of ultra-high molecular weight material 127 between the racks 126 of the rack and pinion assembly 120 furthermore reduces the coefficient of friction between the rack and pinion assembly 120 and the frame 34 as the gate 50 moves toward an open position.

As mentioned above, lock assembly 150 is preferably designed to automatically return to a locked condition. As will be appreciated from an understanding of this disclosure, after element or gate 50 moves toward an open position, the cam locking members 160, 160' tend to rotate in a counter-clockwise direction (as seen in FIG. 11) but are inhibited from returning completely to their locked position or condition (illustrated in solid lines FIG. 11). That is, after the gate or element 50 passes beneath the cam locking members 160, 160' in a direction toward an open position, the cam locking members 160, 160' are limited in their return travel as by the peripheral surface 162*b* thereof riding or resting on the upper surface 56 of the gate 50. The cam locking members 160, 160' essentially remain in this position during the reminder of the opening of element or gate 50, and also as the element or gate 50 returns to the closed position illustrated in FIG. 11. As element or gate 50 continues to move in a closing direction (to the left as seen in FIG. 11), it will ultimately move to the closed position at which position the edge of the gate or element 50 passes from beneath the cam locking members 160, 160'. When this occurs, the ability of the lock mechanism 150 to automatically return to the locked condition automatically returns the cam locking members 160, 160' to the position (illustrated in solid lines in FIG. 11) whereat the peripheral surface 162*b* again self-engages a portion of element or gate 50 in a manner inhibiting inadvertent movement of element or gate 50 toward the open position.

To effect vacuum or pneumatic unloading of the lading from the hopper car 10, the closure assembly 250 on both ends of the transition or outlet tubes 240, 242 of pan assembly 70 are opened and a vacuum intake (not shown) is connected to one of the outlet tubes 240, 242. Thereafter, the gate or first element 50 is opened in the manner described above to allow lading or materials to fall into the chamber 77 of the open top pan assembly 70. As will be appreciated by those skilled in the art, air is admitted through the opposite outlet tube and flows through the passage 232 defined by the deflector or hood 220 to the vacuum intake. Lading particles or material in the hopper pass through the elongated lengthwise opening 236 leading to the passage 232 defined by the hood 220 where the air flow carries the particles through the passage 232 from whence they are drawn to the vacuum intake.

After the lading or material is pneumatically withdrawn from the hopper car 10, the gate 50 of the gate assembly 30 may be returned to its closed position and the pan assembly 70 is moved to the open position. The lock assembly 150 serves in the same manner described above to releasably lock or maintain the gate 50 in the closed position. After again releasing the lock assembly 150, the pan assembly 70 is moved to the open position to allow any residue materials remaining in the pan assembly 70 to be removed and cleaned therefrom. The ability to move or rotate the deflector or hood 220 from the position illustrated in FIG. 17 to the position illustrated in FIG. 18 facilitates cleaning of the pan assembly 70.

Following cleaning thereof, the pan assembly 70 is returned to the closed position whereat it is releasably locked in place by the lock mechanism 150. Hingedly mounting the deflector 220 to the pan assembly serves many purposes. As mentioned, hingedly mounting the deflector or hood 220 to the pan assembly 70 allows the deflector or hood 220 to be moved to facilitate cleaning of the pan assembly 70. Moreover, hingedly connecting the hood 220 to the pan assembly 70 maintains the hood or deflector 220 in position relative to the ports or openings 224 leading from the pan assembly 70. Additionally, hingedly mounting the deflector or hood structure 220 to the pan assembly 70 inhibits inadvertent damage to the hood structure 220. That is, should the hood structure 220 remain in an open position as the pan assembly 70 moves toward the closed position, the hinged connection with the pan assembly 70 allows the hood structure 220 to automatically pivot into place thereby reducing the likelihood of damage thereto.

The closure assembly 250 associated with each outlet tube 240, 242 of the pan assembly 70 furthermore facilitates pneumatic discharge of material from the hopper car 10. With the closure assembly 250, one-handed operation of each closure assembly 250 can be effected. Moreover, the cam structure 260 associated with each closure assembly 250, when operated in combination with the retainer apparatus 280, allows for a substantially equally distributed force to be applied to the gasket 254 used to seal the closure assembly 250 relative to the respective outlet tube 240, 242. Moreover, the preferred design of the closure assembly 250 retains the end cap or cover 252 in operable association with the respective outlet tube whether the cap 252 is in an open position or a closed position.

From the foregoing, it will be observed that numerous modifications and variations can be effected without departing from the true spirit and novel concept of the present invention. Moreover, it will be appreciated the present disclosure is intended to set forth exemplifications of the invention which are not intended to limit the invention to the specific embodiments illustrated. Rather, this disclosure is intended to cover by the appended claims all such modifications and variations as fall within the spirit and scope of the claims.

What is claimed is:

1. A discharge gate assembly for a railroad hopper car, said discharge gate assembly comprising:

a rigid frame defining a discharge opening;

a first element carried by said frame and extending across said discharge opening;

a second element carried by said frame and extending across said discharge opening, said first and second elements being arranged in vertically spaced relation relative to each other;

a first drive mechanism including a first operating shaft assembly mounted on said frame for moving said first element relative to said frame;

a second drive mechanism including a second operating shaft assembly mounted on said frame for moving said second element relative to said frame; and wherein said first and second operating shafts are each rotatably mounted about an axis which is fixed relative to the frame, with said axes being disposed in a substantially common horizontal plane relative to each other.

2. The discharge gate assembly according to claim 1 wherein said first and second drive mechanisms each include a rack and pinion assembly arranged in operable combination with the operating shaft assembly of the respective drive mechanism.

3. The discharge gate assembly according to claim 2 wherein each rack and pinion assembly includes a rack operably associated with a respective element, and with each rack being movable along a predetermined path of travel concomitantly with said respective element.

4. The discharge gate assembly according to claim 3 wherein a centerline of each operating shaft assembly is disposed to a common vertical side of the predetermined path of travel of the respective rack of said rack and pinion assembly.

5. The discharge gate assembly according to claim 1 further including seal structure arranged in combination with said frame and said second element for inhibiting contaminants from passing inwardly toward said discharge opening.

6. The discharge gate assembly according to claim 1 further including a lock mechanism for inhibiting inadvertent movement of said first element relative to said frame.

7. The discharge gate assembly according to claim 1 further including a lock mechanism for inhibiting inadvertent movement of said second element relative to said frame.

8. The discharge gate assembly according to claim 1 wherein said first element is a discharge gate slidably moveable along a generally horizontal path of travel relative to said frame, with said gate having an upper surface and a lower surface.

9. The discharge gate assembly according to claim 8 wherein said frame further includes a stationary support extending across said discharge opening beneath the lower surface of said gate and above said second element.

10. The discharge gate assembly according to claim 1 wherein said second element is a pan assembly movable along a generally horizontal path of travel relative to said frame.

11. The discharge gate assembly according to claim 1 wherein said first operating shaft assembly includes an operating shaft supported on said frame for rotation and having capstans removably connected at opposite ends thereof.

12. The discharge gate assembly according to claim 1 wherein said first operating shaft assembly includes an operating shaft supported on said frame for rotation and having capstans removably connected at opposite ends thereof.

13. The discharge gate assembly according to claim 1 wherein a tamper seal arrangement is provided in combination with said first drive mechanism for accepting a seal for visually indicating whether said first element has been moved toward an open position.

14. The discharge gate assembly according to claim 1 wherein seal structure is provided between said first element and said frame for inhibiting debris from passing inwardly toward said discharge opening.

15. The discharge gate assembly according to claim 1 wherein said first element and second element are each mounted on the rigid frame in generally parallel relationship relative to each other.

16. A discharge gate assembly for a railroad car, said gate assembly comprising:

a frame structure configured for attachment to said hopper car and defining a discharge opening, said frame structure including a pair of side walls extending generally parallel to a longitudinal axis of said hopper car and a pair of end walls rigidly interconnected to said side walls;

a first element mounted on said frame structure for sliding movement relative to said discharge opening between open and closed positions;

a second element mounted on said frame structure beneath said first element for sliding movement relative to said discharge opening between open and closed positions;

a first drive mechanism including a first operating shaft assembly mounted on said frame for rotation about a first axis which is fixed relative to the frame structure, and with said first drive mechanism moving said first element between said open and closed positions;

a second drive mechanism including a second operating shaft assembly mounted on said frame in horizontally spaced relation from said first operating shaft assembly for rotation about a second axis which is fixed relative to the frame structure, with said second drive mechanism moving said second element between said open and closed positions; and wherein said first and second operating shaft assemblies each extend generally parallel to an end wall of said frame structure and are arranged in a substantially common horizontal plane relative to each other to minimize the distance said gate assembly depends from said hopper car thereby enhancing clearance under the gate assembly.

17. The discharge gate assembly according to claim 16 wherein said first and second drive mechanisms each include a rack and pinion assembly arranged in operable combination with the operating shaft assembly of the respective drive mechanism.

18. The discharge gate assembly according to claim 17 wherein each rack and pinion assembly includes a pair of laterally spaced racks extending generally parallel to a side wall of said frame structure and operably associated with a respective element such that said racks and their respective element concomitantly move relative to each other, with said racks being movable along a predetermined path of travel, and wherein each rack and pinion assembly further includes pinions arranged in intermeshing relation relative to said racks.

19. The discharge gate assembly according to claim 18 wherein the fixed axes of said first and second operating shaft assemblies are disposed to a common vertical side of the predetermined path of travel of the racks of said rack and pinion assemblies thereby allowing the operating shaft assemblies to rotate in common directions to close the first and second elements and in common directions to open the first and second elements.

20. The discharge gate assembly according to claim 18 wherein the racks of each rack and pinion assembly are disposed outwardly from and to opposite sides of the discharge opening defined by said frame structure.

21. The discharge gate assembly according to claim 18 wherein said frame structure further includes a rigid stationary support extending across said discharge opening and beneath said first element for inhibiting deflection of said first element.

22. The discharge gate assembly according to claim 18 wherein said racks of said second drive mechanism are disposed in elevated relation relative to an underlying portion of said frame structure for effectively lowering the coefficient of friction between the racks operably associated with said second element and said frame structure.

23. The discharge gate assembly according to claim 16 further including a lock mechanism for inhibiting inadvertent movement of said first element relative to said frame structure.

24. The discharge gate assembly according to claim 16 further including a lock mechanism for inhibiting inadvertent movement of said second element relative to said frame structure.

25. The discharge gate assembly according to claim 16 further including a lock mechanism for inhibiting inadvertent movement of either said first element or said second element relative to said frame structure.

26. The discharge gate assembly according to claim 25 wherein said lock mechanism comprises a manually operated assembly including an elongated shaft operably arranged between the first and second operating shaft assemblies.

27. The discharge gate assembly according to claim 16 wherein said first element is a discharge gate sidably movable along a generally horizontal path of travel relative to said frame structure, with said gate having upper and lower surfaces.

28. The discharge gate assembly according to claim 16 wherein said second element is an open top pan assembly defining a chamber having an opening through which particulate material can be removed under the influence of a pressure differential.

29. The discharge gate assembly according to claim 16 wherein said first operating shaft assembly is of multipiece construction and includes an operating shaft rotatably mounted on said frame structure, said operating shaft having capstans removably attached at opposite ends thereof.

30. The discharge gate assembly according to claim 16 wherein said second operating shaft assembly is of multipiece construction and includes an operating shaft rotatably mounted on said frame structure, said operating shaft having capstans removably attached at opposite ends thereof.

31. The discharge gate assembly according to claim 16 further including a tamper seal arrangement provided on said first drive mechanism for accepting a breakable seal for visually indicating whether said first element has been moved toward an open position.

32. The discharge gate assembly according to claim 16 further including seal structure between said first element and said frame for inhibiting debris from passing inwardly toward said discharge opening.

33. The discharge gate assembly according to claim 16 wherein the first element and second element are each mounted on the frame for movement in generally parallel directions relative to each other.

34. A combination gravity/pneumatic hopper car discharge gate assembly, comprising:

a four sided frame structure defining a discharge opening, said frame structure including a pair of generally parallel side walls having diverging angular surfaces extending upwardly from said opening toward an upper surface of said frame structure and a pair of generally parallel end walls having diverging angular surfaces extending upwardly from said opening toward said upper surface of said frame structure, said frame structure further including spaced parallel beams extending from said side walls of said frame structure to define extensions thereof;

a gate supported on said frame structure for generally linear sliding movement along a predetermined path of travel and in opposed directions extending across said discharge opening between open and closed positions;

a vacuum pan assembly carried on said frame structure beneath said gate for generally linear sliding movement along a predetermined path of travel and in opposed directions extending across said discharge opening between open and closed positions, said pan assembly defining a chamber disposed below said gate, with said chamber having pneumatic inlet and outlet conduits leading therefrom;

a first drive mechanism including a first operating shaft assembly arranged in combination with said beams of said frame structure and which rotates about a first axis which is fixed relative to the frame structure and which is disposed above the predetermined path of travel of and for moving said gate between said open and closed positions in response to operation of said first drive mechanism;

a second drive mechanism including a second operating shaft assembly arranged in combination with said beams of said frame structure and which rotates about a second axis which is fixed relative to the frame structure and which is disposed above the predetermined path of travel of and for moving said pan assembly between said open and closed positions in response to operation of said second drive mechanism; and wherein said first and second operating shaft assemblies are arranged a substantially equivalent vertical distance from the upper surface of and extend generally parallel to the end walls of said frame structure.

35. The combination gravity/pneumatic hopper car discharge gate assembly according to claim 34 wherein said frame structure further includes a stationary support extending across said opening beneath said gate for inhibiting said gate from deflecting beyond a predetermined limit.

36. The combination gravity/pneumatic hopper car discharge gate assembly according to claim 34 wherein ultra-high molecular weight polyethylene material is disposed between an undersurface of said gate and said support to promote sliding movement of said gate relative to said support.

37. The combination gravity/pneumatic hopper car discharge gate assembly according to claim 34 wherein partially crystalline lightweight thermoplastic material is disposed between an undersurface of said gate and said frame structure for promoting sliding movements of said gate relative to said frame structure.

38. The combination gravity/pneumatic hopper car discharge gate assembly according to claim 34 wherein said first drive mechanism includes a pair of racks extending generally parallel to the side walls of said frame structure and movable concomitantly with said gate, said first drive mechanism further including a pair of pinions mounted on said first operating shaft assembly and arranged in intermeshing relationship with said racks of said first drive mechanism for moving said gate in response to rotation of said first operating shaft assembly.

39. The combination gravity/pneumatic hopper car discharge gate assembly according to claim 38 wherein said racks of said first drive mechanism are disposed to opposite lateral sides of the discharge opening defined by said frame structure.

40. The combination gravity/pneumatic hopper car discharge gate assembly according to claim 39 wherein an ultra-high molecular weight polyethylene material separates said racks of said first drive mechanism from said frame structure thereby lowering the coefficient of friction between said racks of said first drive mechanism and said frame structure as said gate moves between the open and the closed positions.

41. The combination gravity/pneumatic hopper car discharge gate assembly according to claim 38 wherein said racks are separated from said frame structure so as to lower the coefficient of friction between said racks and said frame structure as said gate moves between the open and the closed positions.

42. The combination gravity/pneumatic hopper car discharge gate assembly according to claim 34 wherein said second drive mechanism further includes a pair of racks extending generally parallel to the side walls of said frame structure and movable concomitantly with said pan assembly, said second drive mechanism further including a pair of pinions mounted on said second operating shaft assembly and arranged in intermeshing relationship with said racks of said second drive mechanism for moving said pan assembly in response to rotation of said second operating shaft assembly.

43. The combination gravity/pneumatic hopper car discharge gate assembly according to claim 42 wherein said racks of said second drive mechanism are disposed to opposite lateral sides of the discharge opening defined by said frame structure.

44. The combination gravity/pneumatic hopper car discharge gate assembly according to claim 43 wherein an ultra-high molecular weight polyethylene material separates said racks of said second drive mechanism from said frame structure thereby lowering the coefficient of friction between said racks of said second drive mechanism and said frame structure as said pan assembly moves between the open and the closed positions.

45. The combination gravity/pneumatic hopper car discharge gate assembly according to claim 34 further including a tamper seal arrangement provided on said first drive mechanism for accepting a seal for visually indicating whether the first element has been moved toward the open position.

46. The combination gravity/pneumatic hopper car discharge gate assembly according to claim 34 further including seal structure between said gate and said frame for inhibiting debris from passing inwardly toward said discharge opening.

47. The combination gravity/pneumatic hopper car discharge gate assembly according to claim 34 further including seal structure disposed between said pan assembly and an underside of said gate for inhibiting debris from contaminating the underside of said gate.

48. The combination gravity/pneumatic hopper car discharge gate assembly according to claim 34 further including a lock assembly for inhibiting inadvertent movement of said gate relative to said frame structure.

49. The combination gravity/pneumatic hopper car discharge gate assembly according to claim 48 wherein said lock assembly includes an elongated rotatable shaft supported at opposite ends by said beams of said frame structure, with said shaft having at least one stop member mounted thereon which, when said gate is in the closed position, engages said gate thereby inhibiting significant movement of said gate toward the open position for a first rotational position of said lock assembly, and in another rotational position of said lock assembly said stop member is removed from engagement with the gate and is disposed to allow the gate to move toward the open position.

50. The combination gravity/pneumatic hopper car discharge gate assembly according to claim 49 wherein said lock assembly is manually operated, and wherein the rotatable shaft of said lock assembly defines a longitudinal axis disposed above the path of travel of said gate.

51. The combination gravity/pneumatic hopper car discharge gate assembly according to claim 34 further including a lock assembly for inhibiting inadvertent movement of said pan assembly relative to said frame structure.

52. The combination gravity/pneumatic hopper car discharge gate assembly according to claim 51 wherein said lock assembly includes an elongated rotatable shaft supported at opposite ends by said beams of said frame structure, with said shaft having at least one stop member mounted thereon which, when said pan assembly is in the closed position, engages a portion of said pan assembly thereby inhibiting significant movement of said pan assembly toward the open position for a first rotational position of said lock assembly, and in another rotational position of said lock assembly said stop member is removed from engaging said portion of the pan assembly and is disposed to allow the pan assembly to move toward the open position.

53. The combination gravity/pneumatic hopper car discharge gate assembly according to claim 34 further including a lock assembly for inhibiting inadvertent movement of either said gate or said pan assembly relative to said frame structure.

54. The combination gravity/pneumatic hopper car discharge gate assembly according to claim 53 wherein said lock assembly comprises a manually operated assembly including an elongated shaft operably arranged between and extending generally parallel to the first and second operating shaft assemblies.

55. The combination gravity/pneumatic hopper car discharge gate assembly according to claim 54 wherein said lock assembly further includes a first stop member mounted on said elongated shaft for rotation therewith and which, when said gate is in the closed position, engages said gate thereby inhibiting significant movement of said gate toward the open position for a first rotational position of said lock assembly, and in another rotational position of said lock assembly said stop member is removed from engagement with said gate and is disposed to allow the gate to move toward the open position.

56. The combination gravity/pneumatic hopper car discharge gate assembly according to claim 54 wherein said lock assembly further includes a second stop member mounted on said elongated shaft for rotation therewith and which, when said pan assembly is in the closed position, engages a portion of said pan assembly thereby inhibiting significant movement of said pan assembly toward the open position for a first rotational position of said lock assembly, and in another rotational position of said lock assembly said second stop member is removed from engaging said portion of said pan assembly thereby allowing the pan assembly to move toward the open position.

57. A railroad hopper car having an enclosure for holding and transporting material and an opening through which the material in said enclosure is discharged from said hopper car, and a gate assembly for controlling the discharge of material from said hopper car either pneumatically or gravitationally, said gate assembly comprising:

a rigid frame connected to said enclosure and disposed about said opening;

an open top pan assembly having a pneumatic outlet allowing for material to pass therethrough under the influence of a pressure differential, said pan assembly being slidably mounted on said frame for movements between a closed position, wherein said pan assembly extends beneath and across said opening, and an open position, wherein said pan assembly is removed from beneath said opening;

a gate operably mounted on said frame between said opening and said pan assembly, with said gate being slidably movable between a closed position, wherein said gate extends across said opening, and an open position, wherein said gate is removed from beneath said opening;

a pan assembly drive mechanism including a first operating shaft assembly supported on said frame for rotation about an axis which is spatially fixed relative to the frame, with said first operating shaft assembly moving said pan assembly between the open and closed positions and relative to said opening in response to rotation thereof;

a gate drive mechanism including a second operating shaft assembly supported on said frame for rotation about an axis which is spatially fixed relative to the frame, with said second operating shaft assembly moving said gate between the open and closed positions and relative to said opening in response to rotation thereof; and wherein the first and second operating shaft assemblies are arranged in a substantially common horizontal plane relative to each other to minimize a distance between an upper surface of said frame structure and a lower surface of said pan assembly.

58. The hopper car according to claim 57 wherein said frame further includes a stationary support extending across said opening beneath said gate for inhibiting said gate from deflecting beyond a predetermined limit.

59. The hopper car according to claim 58 wherein ultra-high molecular weight polyethylene material is disposed between an undersurface of said gate and said support to promote sliding movement of said gate relative to said support.

60. The hopper car according to claim 57 wherein partially crystalline lightweight thermoplastic material is disposed between an undersurface of said gate and said frame for promoting sliding movements of said gate relative to said frame.

61. The hopper car according to claim 57 wherein said gate drive mechanism further includes a pair of racks concomitantly movable with said gate, said gate drive mechanism further including a pair of pinions mounted on said second operating shaft assembly and arranged in intermeshing relationship with said racks of said gate drive mechanism for moving said gate in response to rotation of said second operating shaft assembly.

62. The hopper car according to claim 61 wherein said racks of said gate drive mechanism are elevated from said frame so as to lower the coefficient of friction between said racks and said frame as said gate moves between the open and the closed positions.

63. The hopper car according to claim 61 wherein an ultra-high molecular weight polyethylene material separates said racks of said gate drive mechanism from said frame thereby lowering the coefficient of friction between said racks of said gate drive mechanism and said frame as said gate moves between the open and the closed positions.

64. The hopper car according to claim 57 wherein said pan assembly drive mechanism further includes a pair of racks movable concomitantly with said pan assembly, said pan assembly drive mechanism further including a pair of pinions mounted on said first operating shaft assembly and arranged in intermeshing relationship with said racks of said pan assembly drive mechanism for moving said pan assembly in response to rotation of said first operating shaft assembly.

65. The hopper car according to claim 64 wherein an ultra-high molecular weight polyethylene material separates said racks of said pan assembly drive mechanism from said frame thereby lowering the coefficient of friction between said racks of said pan assembly drive mechanism and said frame as said pan assembly moves between the open and the closed positions.

66. The hopper car according to claim 57 further including a tamper seat arrangement provided on said gate drive mechanism for visually indicating whether said gate drive mechanism has been operated to move said gate relative to said frame.

67. The hopper car according to claim 57 further including seal structure disposed between said pan assembly and an underside of said gate for inhibiting debris from contaminating the underside of said gate.

68. The hopper car according to claim 57 further including seal structure between said gate, said pan assembly, and said frame for inhibiting debris from passing inwardly toward said discharge opening.

69. The hopper car according to claim 57 further including a lock assembly for inhibiting inadvertent movement of said gate relative to said frame.

70. The hopper car according to claim 69 wherein said lock assembly includes an elongated rotatable shaft supported at opposite ends by said frame, with said shaft having at least one stop member mounted thereon which, when said gate is in the closed position, engages said gate thereby inhibiting significant movement of said gate toward the open position for a first rotational position of said lock assembly, and in another rotational position of said lock assembly said stop member is removed from engaging said gate and is disposed to allow the gate to move toward the open position.

71. The hopper car according to claim 70 wherein said lock assembly is manually operated, and wherein the rotatable shaft of said lock assembly defines a longitudinal axis disposed above the path of travel of said gate.

72. The hopper car according to claim 57 further including a lock assembly for inhibiting inadvertent movement of said pan assembly relative to said frame.

73. The hopper car according to claim 72 wherein said lock assembly includes an elongated rotatable shaft supported at opposite ends by said frame, with said shaft having at least one stop member mounted thereon which, when said pan assembly is in the closed position, engages a portion of said pan assembly thereby inhibiting significant movement of said pan assembly toward the open position for a first rotational position of said lock assembly, and in another rotational position of said lock assembly said stop member is removed from engaging said portion of said pan assembly thereby allowing the pan assembly to move toward the open position.

74. The hopper car according to claim 73 wherein said lock assembly is manually operated, and wherein the rotatable shaft of said lock assembly defines a longitudinal axis disposed above the path of travel of said pan assembly.

75. The hopper car according to claim 57 further including a lock assembly for inhibiting inadvertent movement of either said gate or said pan assembly relative to said frame and toward their open positions.

76. The hopper car according to claim 75 wherein said lock assembly comprises a manually operated assembly including an elongated shaft rotatably supported toward opposite ends by said frame and operably disposed between said first and second operating shaft assemblies.

77. The hopper car according to claim 76 wherein said lock assembly further includes a first stop member mounted on said elongated shaft for rotation therewith and which, when said gate is in the closed position, engages said gate thereby inhibiting significant movement of said gate toward the open position for a first rotational position of said lock assembly, and in another rotational position of said lock assembly said stop member is removed from engaging the gate and is disposed to allow the gate to move toward the open position.

78. The hopper car according to claim 77 wherein said lock assembly further includes a second stop member mounted on said elongated shaft for rotation therewith and which, when said pan assembly is in the closed position, engages a portion of said pan assembly thereby inhibiting significant movement of said pan assembly toward the open position for a first rotational position of said lock assembly, and in another rotational position of said lock assembly said second stop member is removed from engaging said portion of said pan assembly and is disposed to allow the pan assembly to move toward the open position.

79. A discharge gate assembly for a railroad car, said gate assembly comprising:

a rigid frame structure defining an upper surface for said gate assembly and having interconnected walls defining a discharge opening;

a first element mounted on said frame structure for sliding movement relative to said discharge opening between open and closed positions;

a second element mounted on said frame structure beneath said first element for sliding movement relative to said discharge opening between open and closed positions, with said second element defining a lower surface for said gate assembly;

a first drive mechanism including a first operating shaft assembly for moving said first element between said open and closed positions;

a second drive mechanism including a second operating shaft assembly for moving said second element between said open and closed positions; and wherein said first and second operating shaft assemblies are each mounted on said frame for rotation about an axis which is fixed relative to the frame and are disposed in horizontally adjacent relationship relative to each other and in a substantially common horizontal plane to minimize a distance between said upper surface and said lower surface of said gate assembly.

80. The discharge gate assembly according to claim 79 wherein said first and second drive mechanisms each include rack and pinion assembly arranged in operable combination with the operating shaft assembly of the respective drive mechanism.

81. The discharge gate assembly according to claim 79 wherein each rack and pinion assembly includes a pair of laterally spaced racks extending generally parallel to a side wall of said frame structure and operably associated with a respective element such that said racks and their respective element concomitantly move relative to each other, with said racks being movable along a predetermined path of travel, and wherein each rack and pinion assembly further includes pinions arranged in intermeshing relation relative to said racks.

82. The discharge gate assembly according to claim 81 wherein the pinions of the rack and pinion assembly of the first drive mechanism have a different diameter than the pinions of the rack and pinion assembly of the second drive mechanism such that a vertical distance between the fixed axes of the first and second operating shaft assemblies is minimized.

83. The discharge gate assembly according to claim 81 wherein the fixed axes of said first and second operating shaft assemblies are disposed to a common vertical side of the predetermined path of travel of the racks of said rack and pinion assemblies thereby allowing the operating shaft assemblies to rotate in common directions to close the first and second elements and in common directions to open the first and second elements.

84. The discharge gate assembly according to claim 81 wherein the racks of each rack and pinion assembly are disposed outwardly from and to opposite sides of the discharge opening defined by said frame structure.

85. The discharge gate assembly according to claim 79 further including a lock mechanism for inhibiting inadvertent movement of said first element relative to said frame structure.

86. The discharge gate assembly according to claim 79 further including a lock mechanism for inhibiting inadvertent movement of said second element relative to said frame structure.

87. The discharge gate assembly according to claim 79 further including a lock mechanism for inhibiting inadvertent movement of either said first element or said second element relative to said frame structure.

88. The discharge gate assembly according to claim 79 wherein said first element is a discharge gate sidably movable along a generally horizontal path of travel relative to said frame structure.

89. The discharge gate assembly according to claim 88 wherein said second element is an open top pan assembly sidably movable along a generally horizontal path of travel relative to said frame structure.

90. The discharge gate assembly according to claim 89 wherein the generally horizontal path of travel of the gate and the generally horizontal path of travel of the open top pan assembly extend in generally parallel directions relative to each other.

91. A gate assembly for a railroad hopper car, comprising:

a rigid frame defining a discharge opening; and two elements mounted on the frame for independent movement between open and closed positions relative to said discharge opening through operation of independently operable shaft assemblies, each of which rotates about an axis fixed relative to the frame, with said axes being arranged in a generally common horizontal plane, and with said independently operable shaft assemblies permitting independent movement of the elements relative to the frame while permitting concurrent validation regarding cleanliness of commodity contacting surface areas on the elements as the elements move from their closed position to their open position.

* * * * *